US010266979B2

(12) United States Patent
De Lira et al.

(10) Patent No.: US 10,266,979 B2
(45) Date of Patent: Apr. 23, 2019

(54) MANUAL WASHER

(71) Applicant: Luz Louie Horacio De Lira, Hermosa Beach, CA (US)

(72) Inventors: Luz Louie Horacio De Lira, Hermosa Beach, CA (US); Dorian A. Ferrari, Colorado Springs, CO (US)

( * ) Notice: Subject to any disclaimer, the term of this patent is extended or adjusted under 35 U.S.C. 154(b) by 0 days.

(21) Appl. No.: 15/687,511

(22) Filed: Aug. 27, 2017

(65) Prior Publication Data

US 2019/0062975 A1 Feb. 28, 2019

(51) Int. Cl.

| | |
|---|---|
| ***A47L 13/14*** | (2006.01) |
| ***A47L 13/255*** | (2006.01) |
| ***A47L 13/58*** | (2006.01) |
| ***A47L 15/06*** | (2006.01) |
| ***B25G 1/04*** | (2006.01) |
| ***D06F 5/04*** | (2006.01) |
| ***D06F 13/00*** | (2006.01) |
| ***D06F 13/02*** | (2006.01) |
| ***D06F 23/04*** | (2006.01) |
| ***D06F 37/38*** | (2006.01) |
| ***D06F 39/00*** | (2006.01) |
| ***D06F 39/08*** | (2006.01) |
| ***D06F 39/14*** | (2006.01) |

(52) U.S. Cl.

CPC ..... *D06F 23/04* (2013.01); *A47L 13/14* (2013.01); *A47L 13/255* (2013.01); *A47L 13/58* (2013.01); *A47L 15/06* (2013.01); *B25G 1/04* (2013.01); *D06F 5/04* (2013.01); *D06F 13/00* (2013.01); *D06F 13/02* (2013.01); *D06F 37/38* (2013.01); *D06F 39/00* (2013.01); *D06F 39/083* (2013.01); *D06F 39/14* (2013.01)

(58) Field of Classification Search

CPC ..... A47L 13/14; A47L 13/58; A47L 13/255; A47L 15/16; B25G 1/04; D06F 5/04; D06F 13/00; D06F 13/02; D06F 23/04; D06F 37/38; D06F 39/00; D06F 39/083; D06F 39/14

USPC ..... 15/98, 119.1, 228, 260; 68/132, 137, 68/214; 134/187

See application file for complete search history.

(56) References Cited

U.S. PATENT DOCUMENTS

| | | | |
|---|---|---|---|
| 452,617 | A | 5/1891 | Satterlee |
| 1,350,823 | A | 8/1920 | Maples |
| 1,354,022 | A | 9/1920 | Conover |
| 1,384,121 | A | 7/1921 | Deitz |
| 2,025,840 | A | 12/1935 | Wright |
| 3,129,575 | A | 4/1964 | Biffani |
| 4,341,034 | A | 7/1982 | Tsui et al. |
| 8,316,502 | B2 | 11/2012 | Shao |
| 8,438,749 | B2 | 5/2013 | Lee |
| 8,739,347 | B2 | 6/2014 | Lin |

(Continued)

FOREIGN PATENT DOCUMENTS

| | | |
|---|---|---|
| CN | 203049285 | 4/2013 |

OTHER PUBLICATIONS https://www.facebook.com/GiraDora/ ; Wondrful Engineering 2017.

(Continued)

*Primary Examiner* — Levon J Shahinian

(74) *Attorney, Agent, or Firm* — Patent Law Agency, LLC; Peter Ganjian

(57) ABSTRACT

A manually operated washing machine, with first mode of operation with an agitating wash and rinse cycle for washing laundry and a second mode of operation with spin cycle for spinning the washed laundry to extract water.

15 Claims, 50 Drawing Sheets

(56) References Cited

U.S. PATENT DOCUMENTS

| | | | |
|---|---|---|---|
| 8,959,697 | B2 | 2/2015 | Yu |
| 2010/0287722 | A1 | 11/2010 | Yu |
| 2012/0047675 | A1 | 3/2012 | Chu |
| 2012/0192373 | A1 | 8/2012 | Chen |
| 2012/0233794 | A1 | 9/2012 | Yu |

OTHER PUBLICATIONS

GiraDora Frequently Asked Questions 2012.
Pedal powered GiraDora ; http://inhabitat.com/human-powered-giradora-washer-needs-no-electricity ; Feb. 19, 2017.
SpinCyle Pedal Powered Washing Machine (Look North) Youtube; Oct. 5, 2011.
wayfair.com ; Laundry Pod by The Laundry Pod; 2002-2017.
The Wonder Wash ; The Laundry Alternative Inc. 2015.
DRUMI ; http://www.yirego.com/drumi 2016.
PCT/US2018/48033; Filed: Aug. 28, 2018; Search Report and Written Opinion; dated: Oct. 2, 2018.

100

104

MANUAL WASHER

CROSS-REFERENCE TO RELATED APPLICATIONS

All documents mentioned in this specification are herein incorporated by reference to the same extent as if each individual document was specifically and individually indicated to be incorporated by reference.

It should be noted that throughout the disclosure, where a definition or use of a term in any incorporated document(s) is inconsistent or contrary to the definition of that term provided herein, the definition of that term provided herein applies and the definition of that term in the incorporated document(s) does not apply.

BACKGROUND OF THE INVENTION

Field of the Invention

One or more embodiments of the present invention relate to a manually operated (human powered) washer with wash, rinse, and spin cycle.

Description of Related Art

Conventional manually operated washing machines are well known and have been in use for a number of years. However, most do an inadequate job in cleaning laundry. For example, during a wash, rinse, and spin cycles, the laundry is merely rotated continuously in only one direction (generating an internal centrifugal force) that moves laundry away from the center of the wash container and towards the walls thereof, spinning the laundry in a stationary position. The laundry is mostly stationary within the washer container, and simply spins in its stationary position without much movement. Most (but not all) conventional manual washers also use the same one-direction, continuously rotating spinning motion for washing, rinsing, and spinning (to rinse out water from clothes).

Accordingly, in light of the current state of the art and the drawbacks to current manually operated (human powered) washing machines mentioned above, a need exists for a manually operated (human powered) washing machine that would agitate laundry to thereby prevent laundry from being fixed to a stationary position during wash and rinse cycles and further, include a spin cycle for rinsing out water from clothing.

BRIEF SUMMARY OF THE INVENTION

A non-limiting, exemplary aspect of an embodiment of the present invention provides a manually operated washing machine, comprising:

a first mode of operation for agitating laundry for washing and rinsing; and a second mode of operation for spinning laundry for substantially extracting excess water from washed and rinsed laundry.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

Figure 1A:
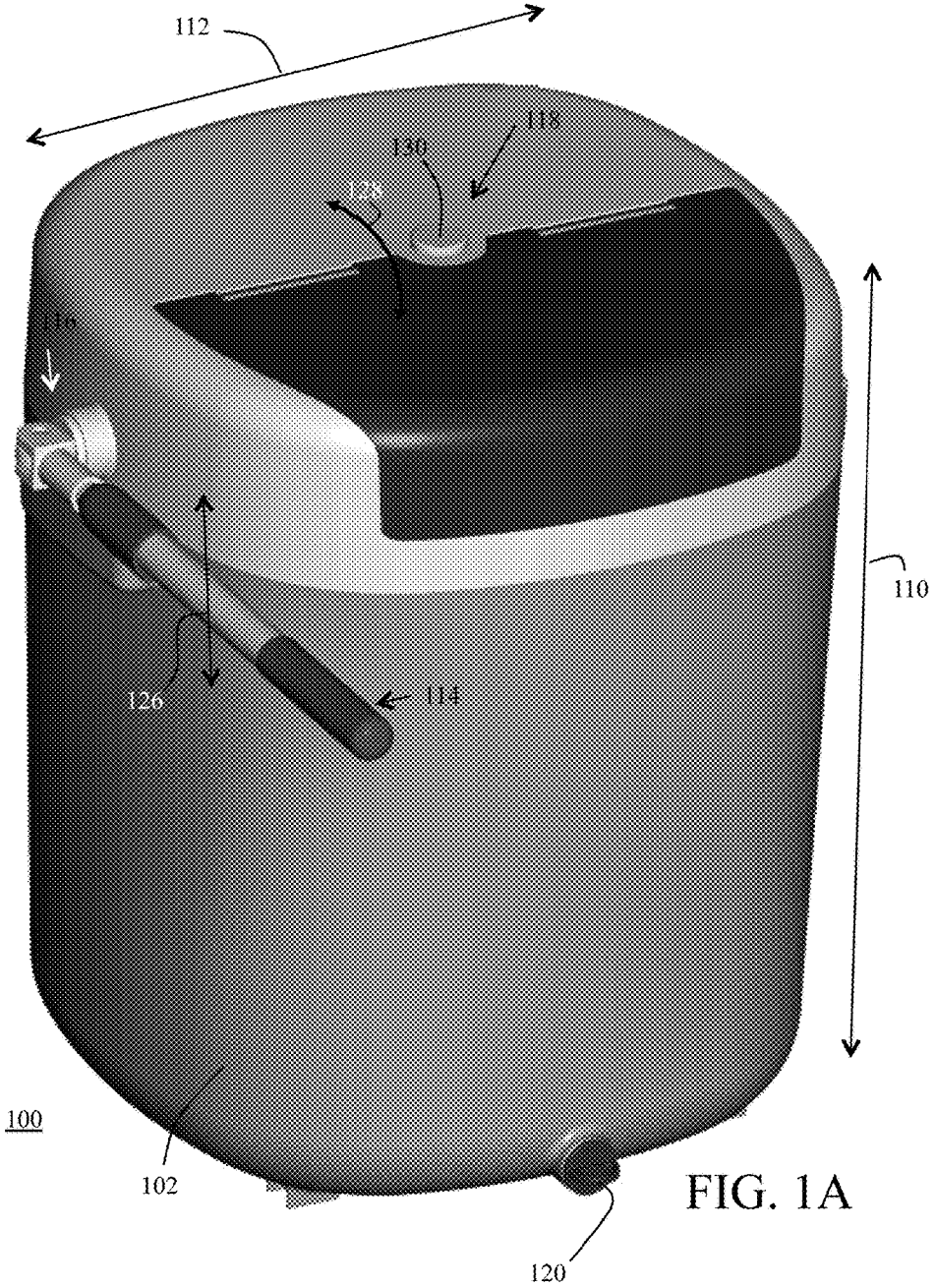
FIGS. 1A to 1M are non-limiting, exemplary illustrations of a manually operated washing machine in accordance with one or more embodiments of the present invention.
Figure 1B:
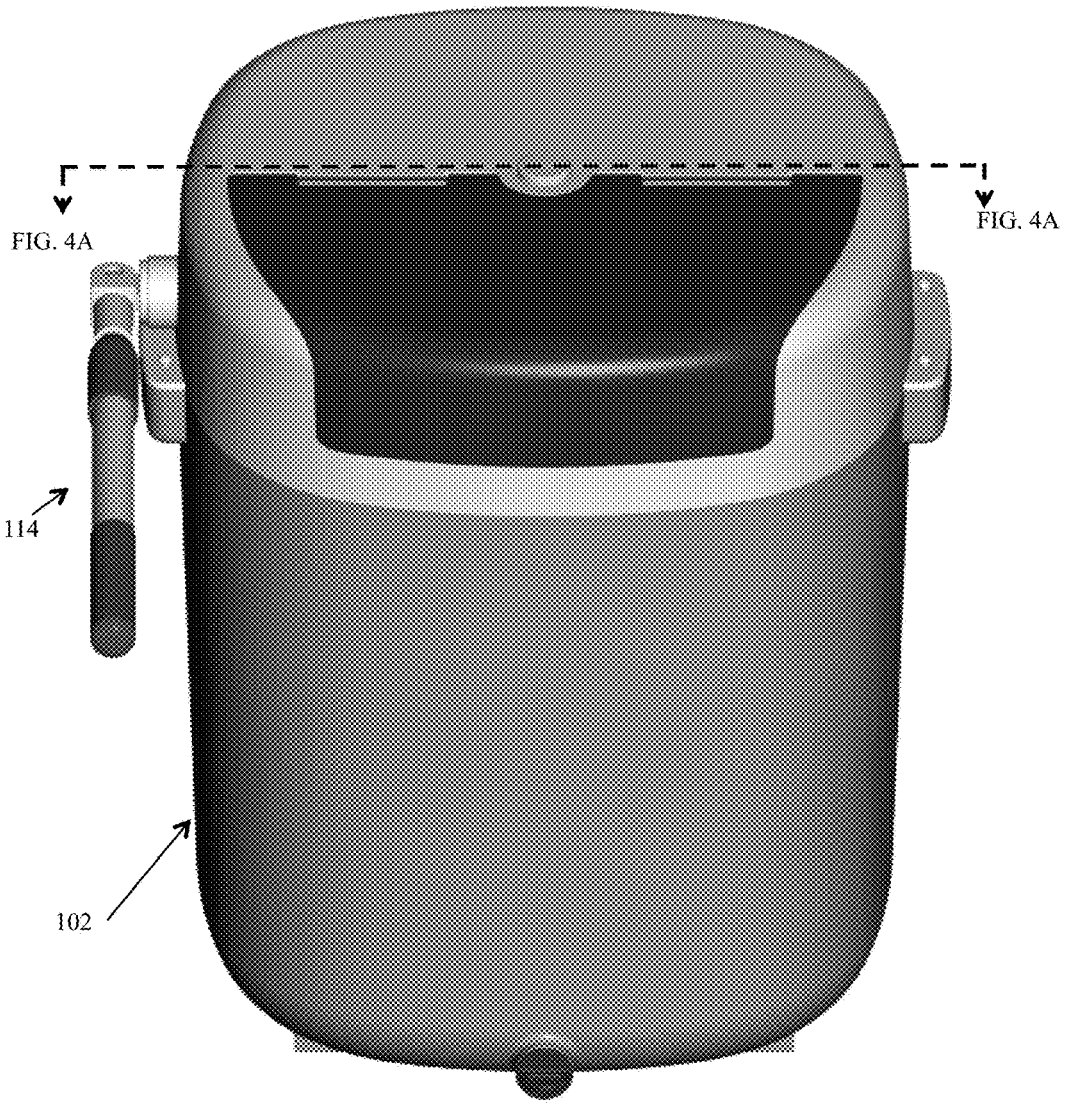
Figure 1C:
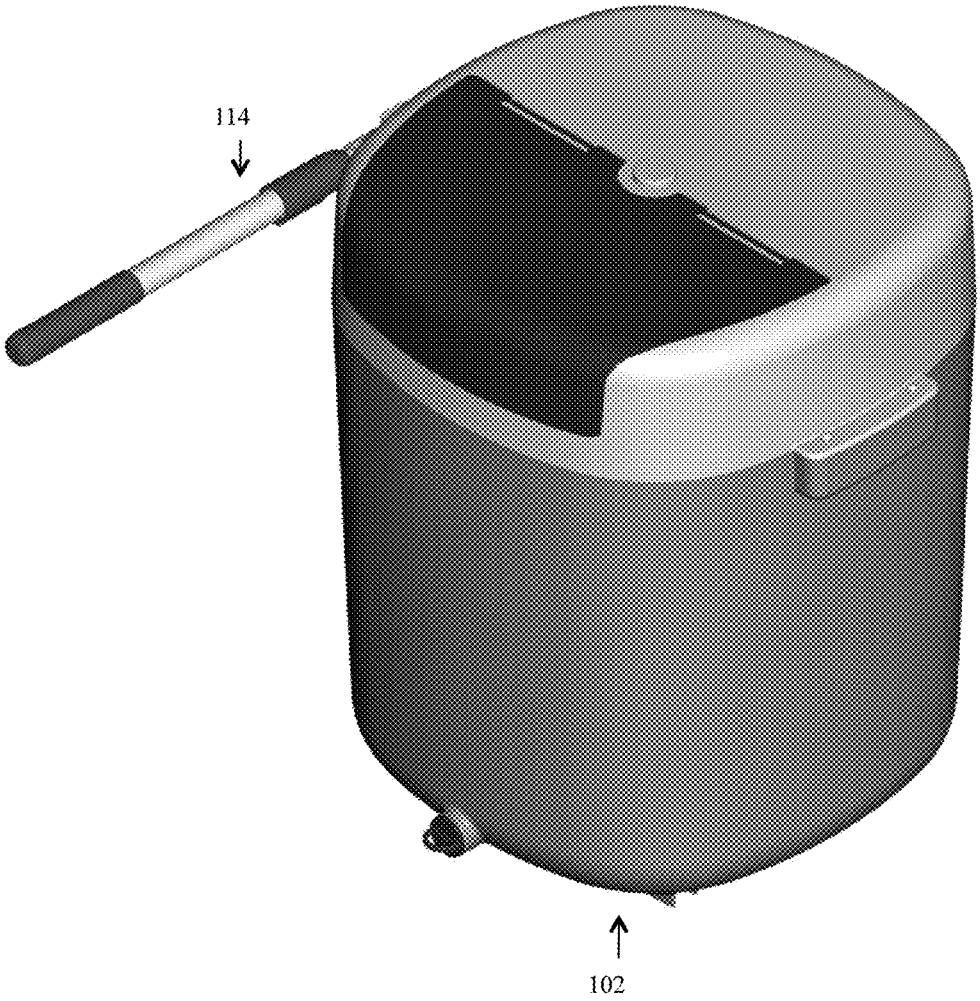

The detailed description set forth below in connection with the appended drawings is intended as a description of presently preferred embodiments of the invention and is not intended to represent the only forms in which the present invention may be constructed and or utilized.

It is to be appreciated that certain features of the invention, which are, for clarity, described in the context of separate embodiments, may also be provided in combination in a single embodiment. Conversely, various features of the invention that are, for brevity, described in the context of a single embodiment may also be provided separately or in any suitable sub-combination or as suitable in any other described embodiment of the invention. Stated otherwise, although the invention is described below in terms of various exemplary embodiments and implementations, it should be understood that the various features and aspects described in one or more of the individual embodiments are not limited in their applicability to the particular embodiment with which they are described, but instead can be applied, alone or in various combinations, to one or more of the other embodiments of the invention.

One or more embodiments of the present invention provide a manually operated (human powered) washing machine that agitates laundry during first mode of operation to wash and rinse laundry to thereby prevent laundry from being fixed to a stationary position. In other words, one or more embodiments of the present invention provide a manually operated washing machine, comprising an agitating wash and rinse cycle for washing and rinsing of laundry, and a spin cycle for substantially extracting excess water from washed and rinsed laundry.

It should be noted that the first mode of operation is defined to include agitating wash and agitating rinse cycles and the second mode of operation is defined to include the spin cycle.

FIGS. 1A to 1M are non-limiting, exemplary illustrations of a manually operated washing machine in accordance with one or more embodiments of the present invention. As illustrated in FIGS. 1A to 1M and further detailed below, manually operated washing machine 100 includes a tub 102, and a movable basket 104 that is positioned within tub 102.

Tub 102 includes a lid 106 associated with top 108 of tub 102, forming a top load washer. Lid 106 includes a door 110 that when at an open position enables access to interior of tub 102 for placement and removal of laundry.

In general, manually operated washing machine 100 has sufficient height 110, sufficient width 112, and sufficient structural integrity to enable a user to seat on lid 106 and manipulate a handle 114 during a first mode of operation to generate wash or rinse cycle. Of course, door 110 of lid 106 may be closed during wash/rinse cycles.

As further illustrated in FIGS. 1A to 1M, manually operated washing machine 100 includes one handle 114 that is detachably associated with tub 102 at a first position 116 (e.g., FIGS. 1A to 1I, and 1L) during the first mode of operation for wash and rinse cycle and detachably associated with tub 102 at a second position 118 (e.g., FIGS. 1J, 1K, and 1M) during the second mode of operation for a spin cycle (i.e., water extraction cycle). First position 116 is at an upper portion 108 of tub 102 whereas second position 118 is at a general center, adjacent a general center of lid 106.

Figure 1D:
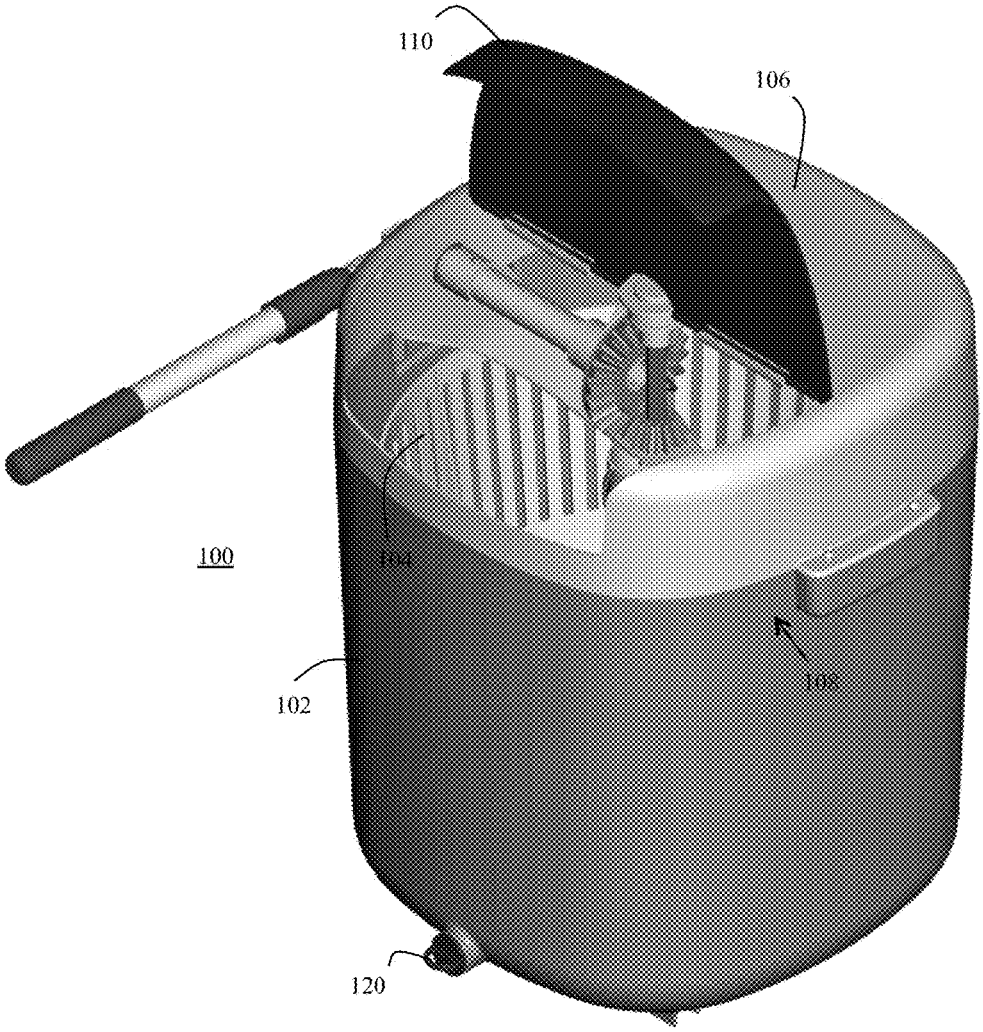
Figure 1E:
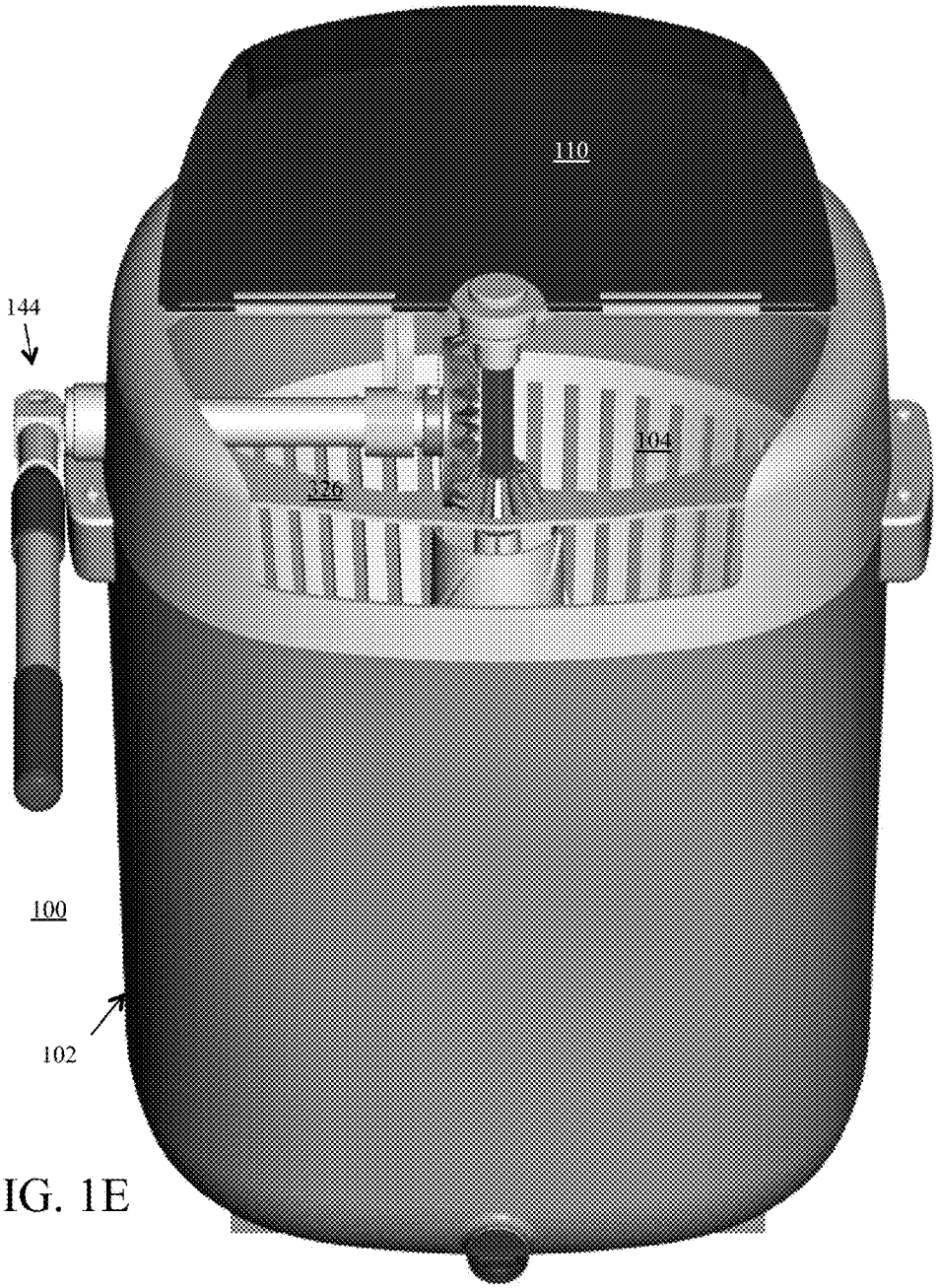
Figure 1F:
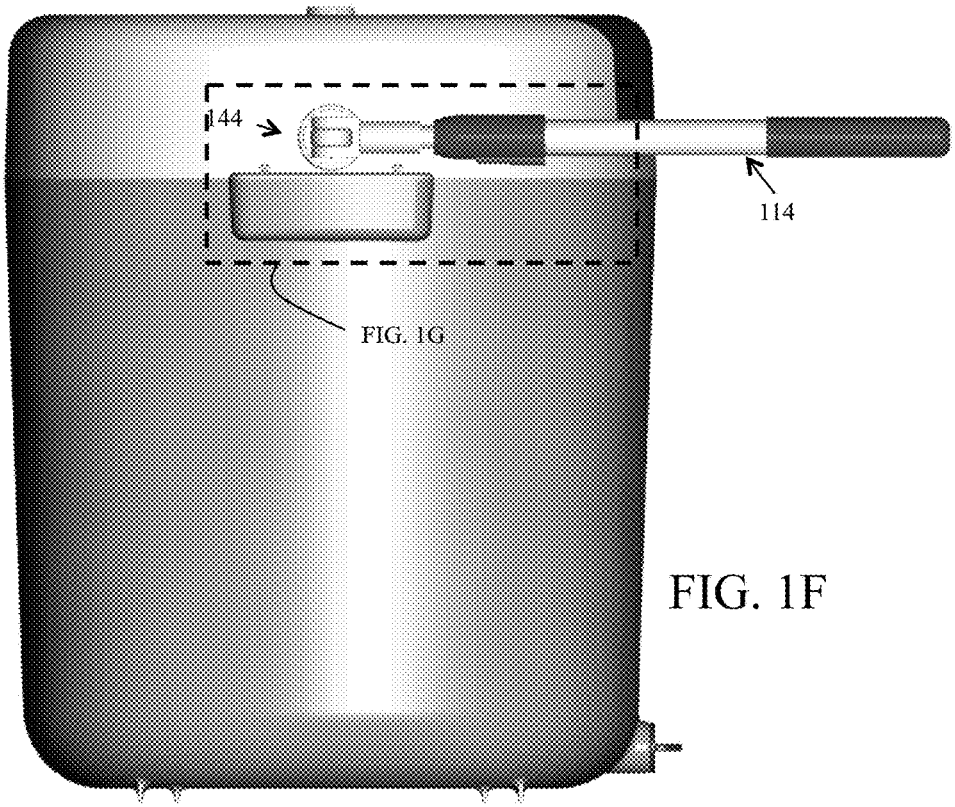
Figure 1G:
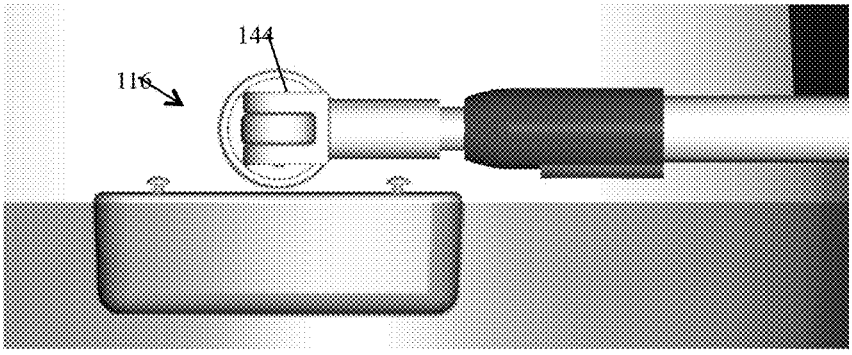
Figure 1H:
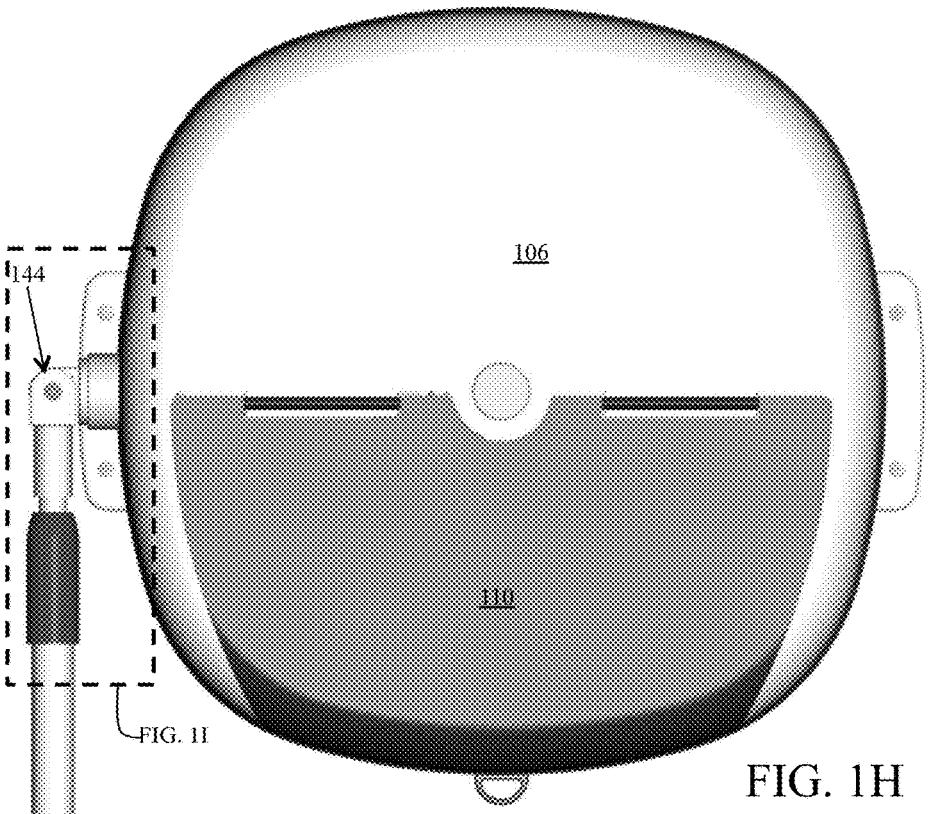
Figure 1I:
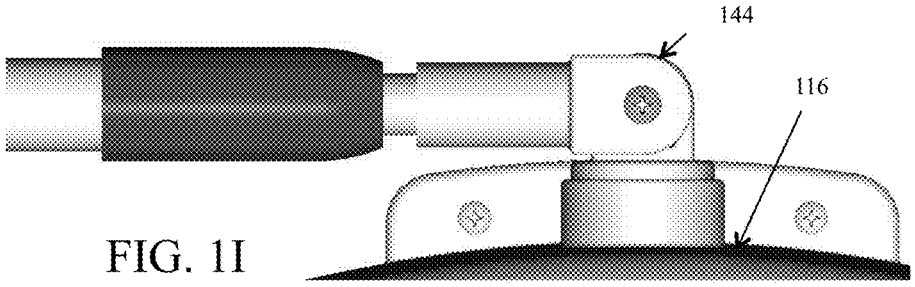
Figure 1J:
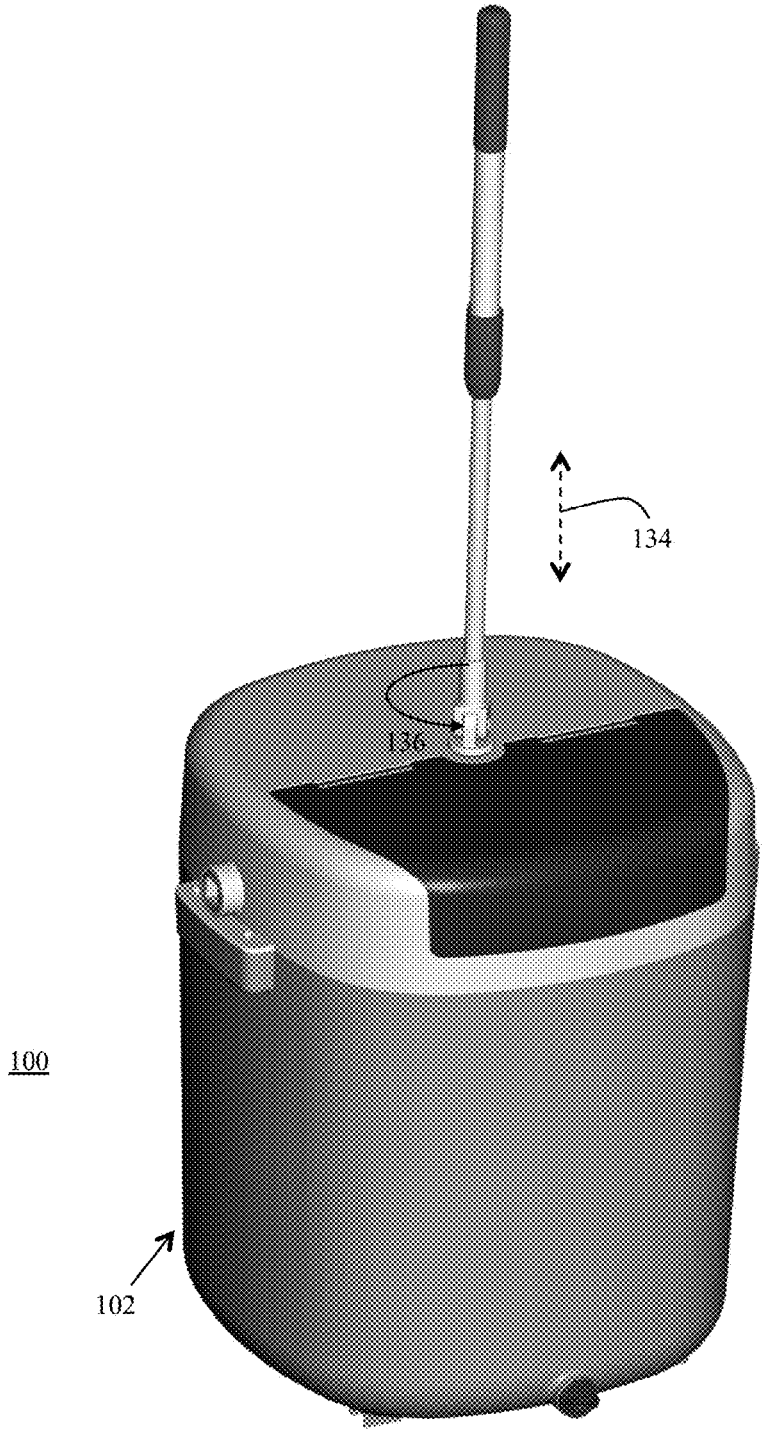
Figure 1K:
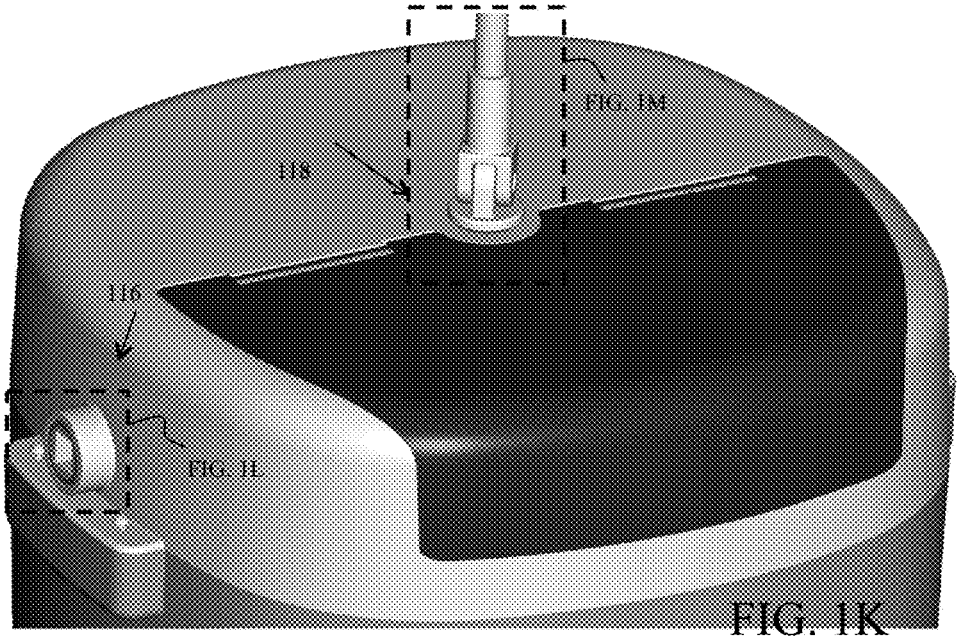
Figure 1M:
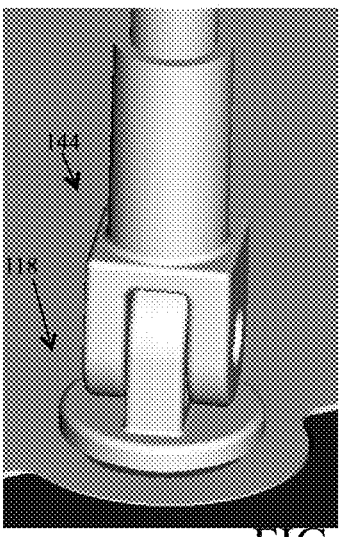
Figure 1L:
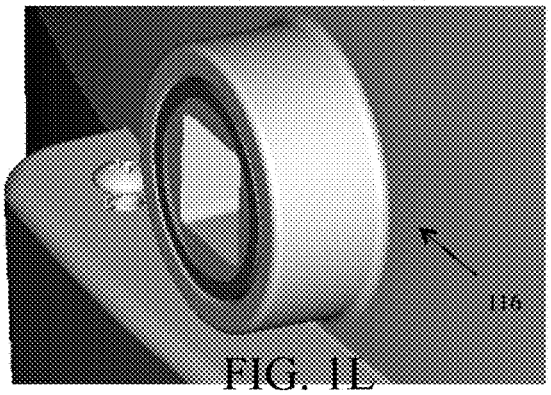
Figure 2A:
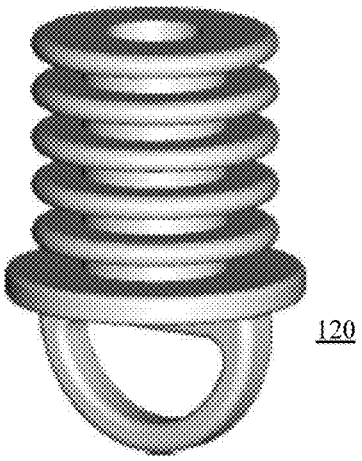
FIGS. 2A and 2B are non-limiting, exemplary illustrations of a drain plug in accordance with one or more embodiments of the present invention.
Figure 2B:
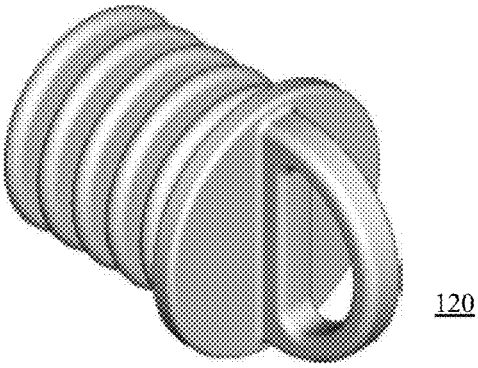
Figure 7A:
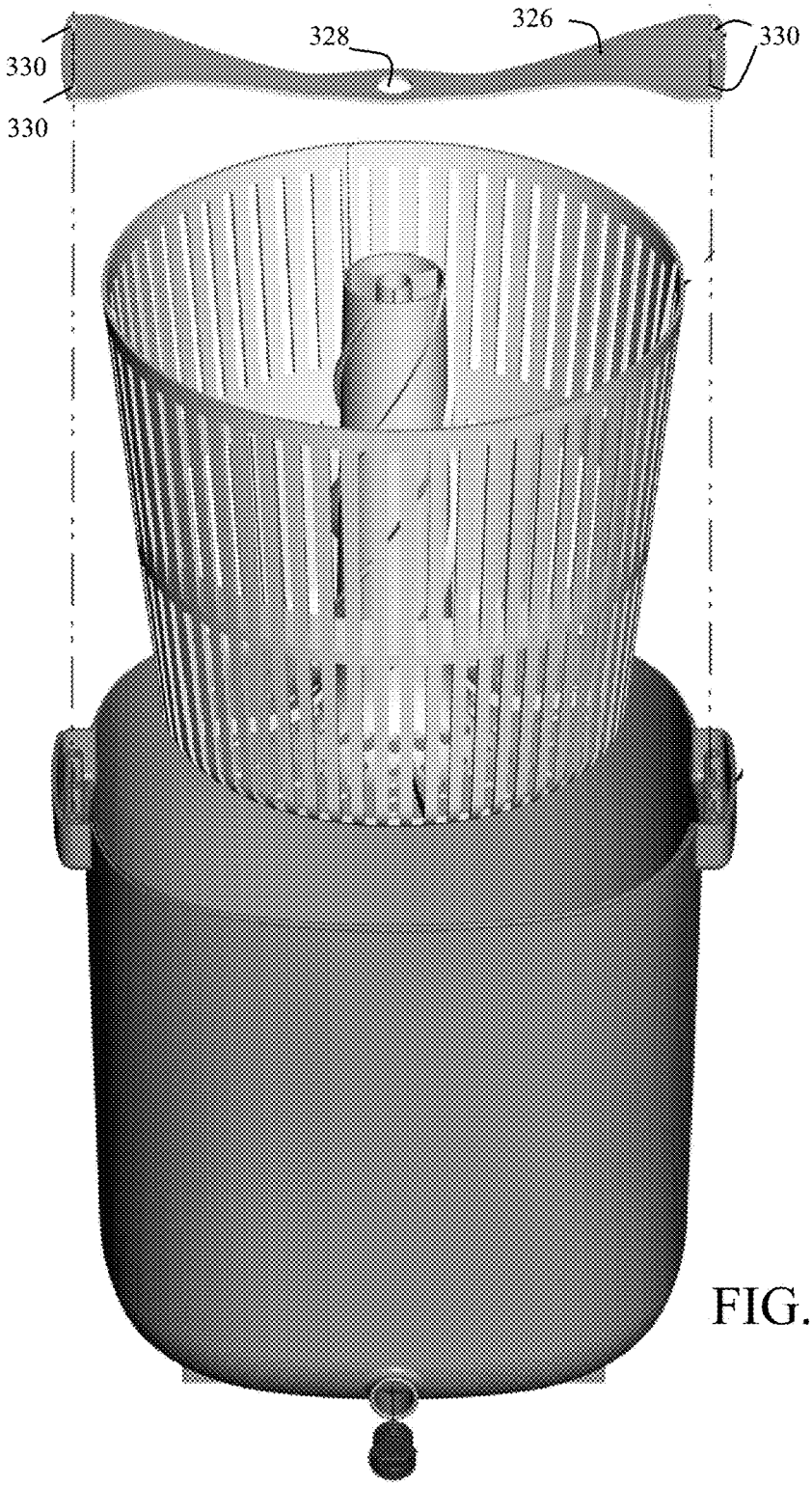
FIGS. 7A to 7J are non-limiting, exemplary illustrations that are generally directed to tub and basket of the manually operated washing machine shown in FIGS. 1A to 6X in accordance with one or more embodiments of the present invention.
Figure 7B:
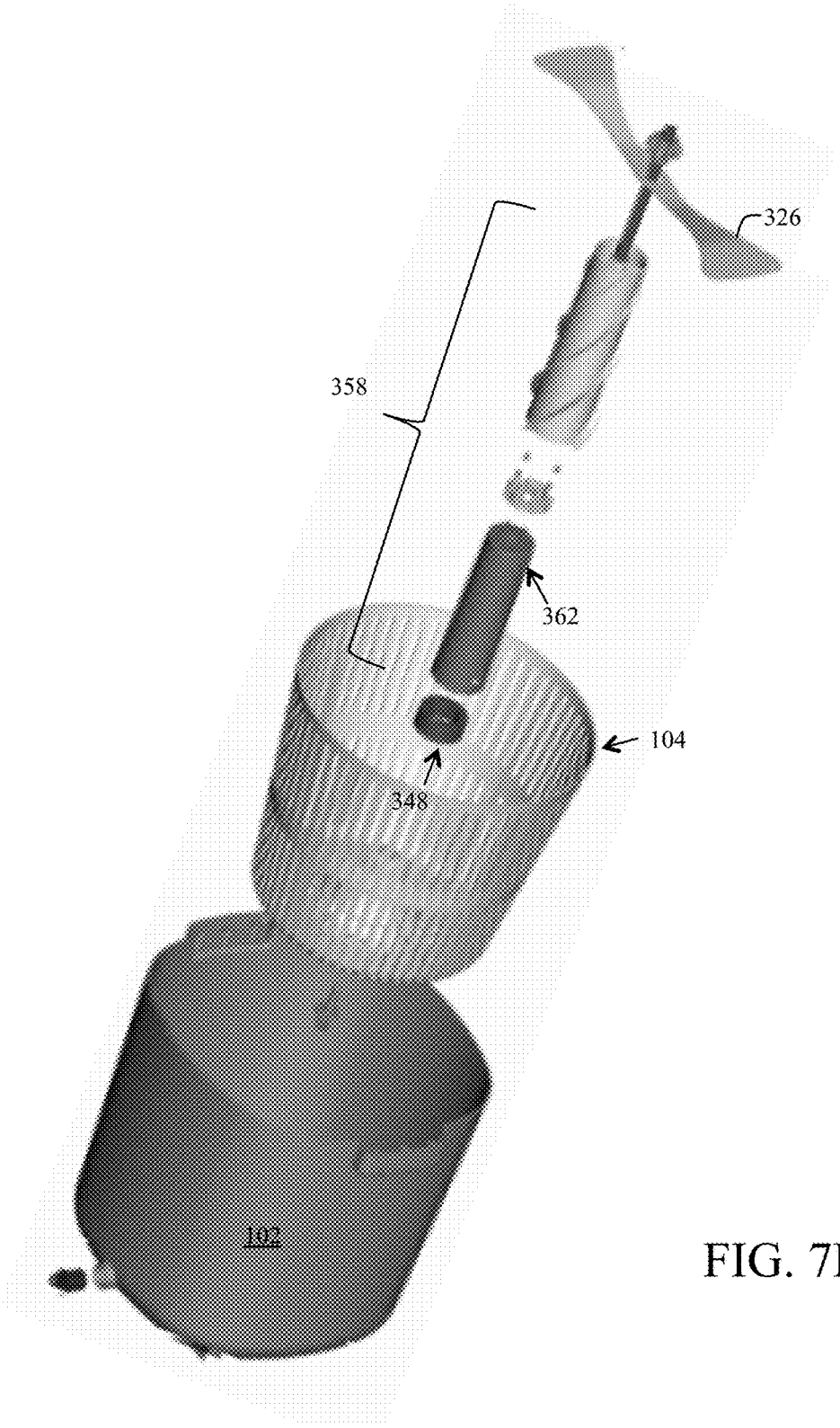
Figure 7C:
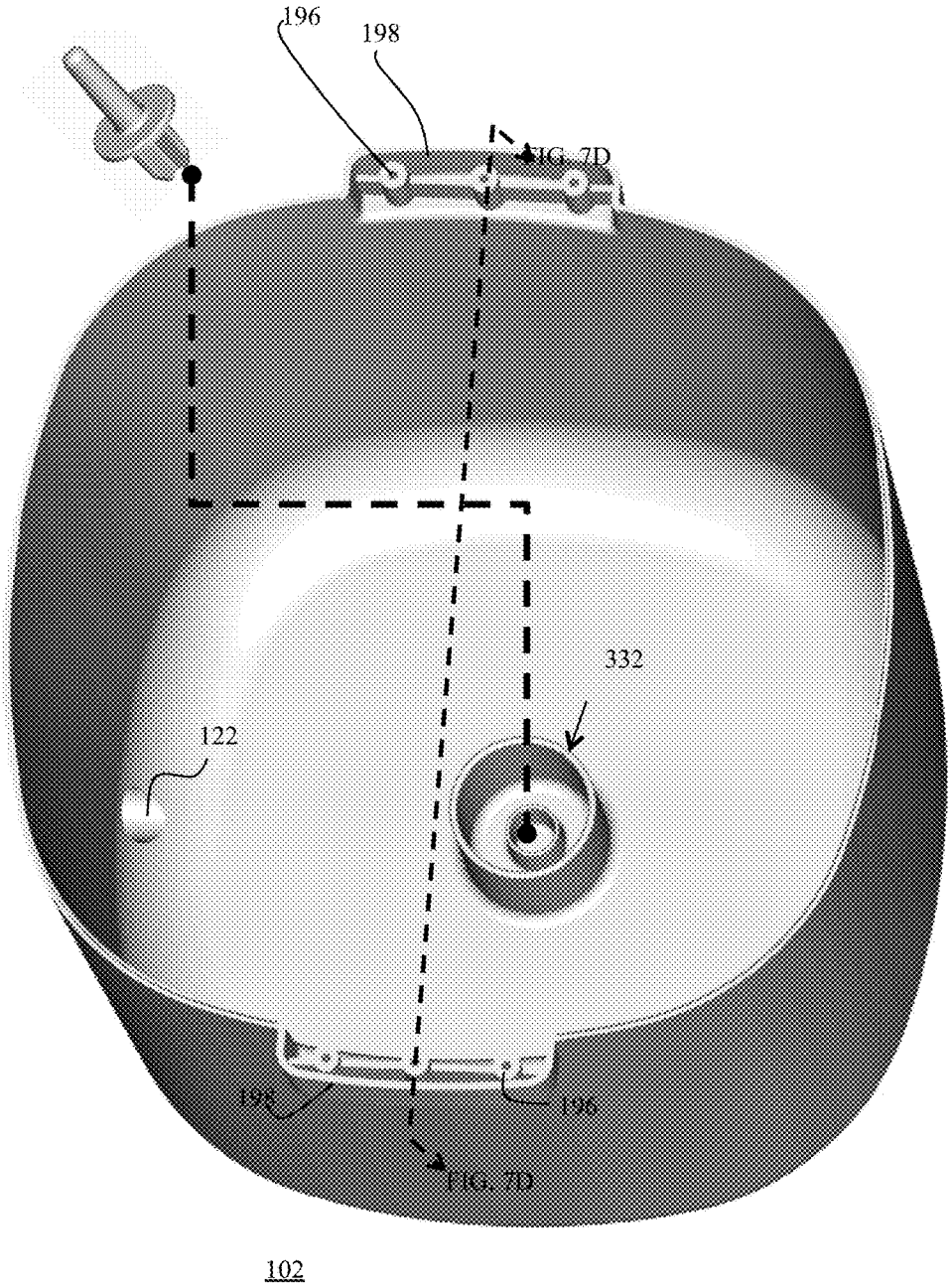
Figure 7D:
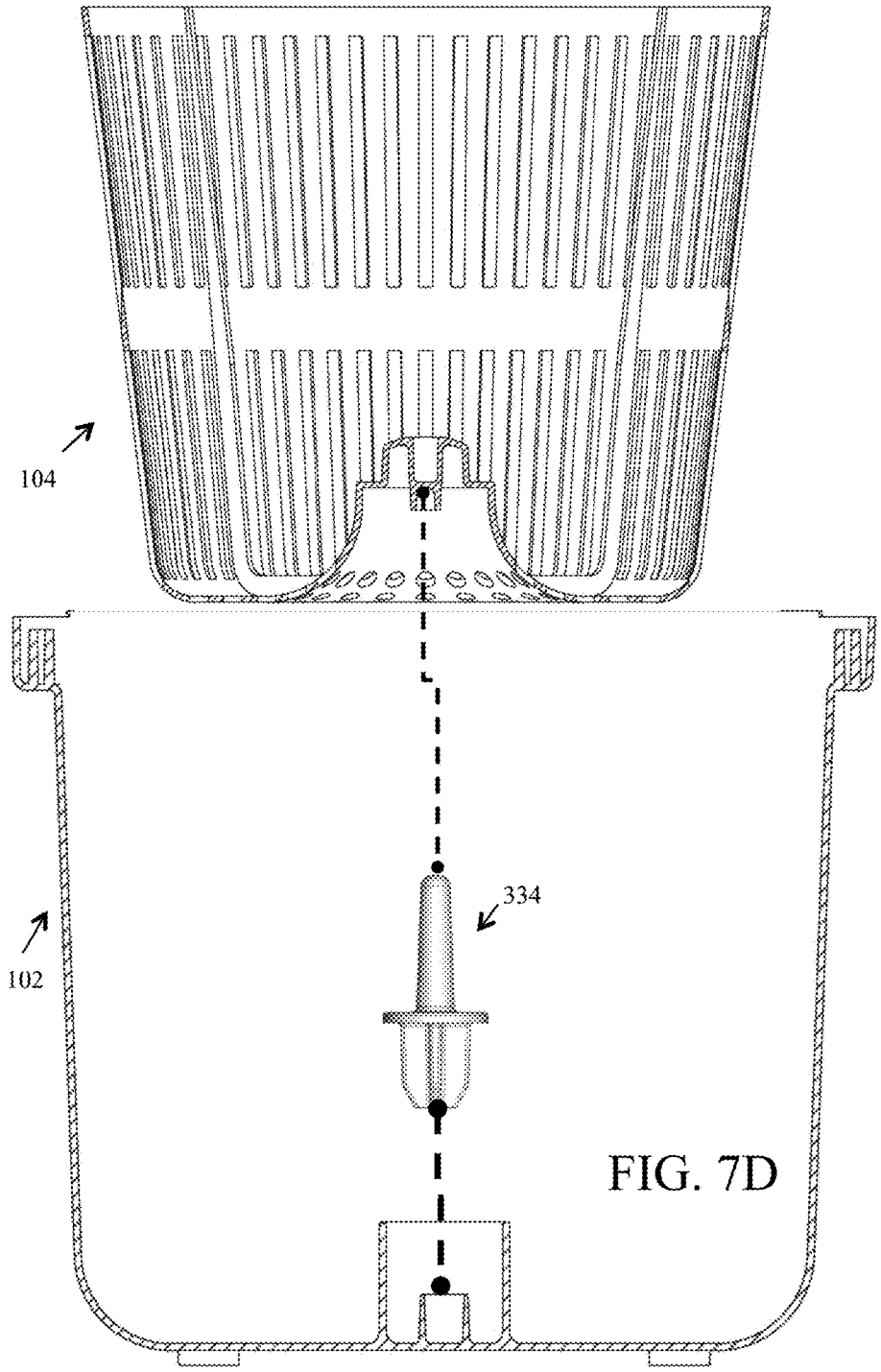
Figure 7E:
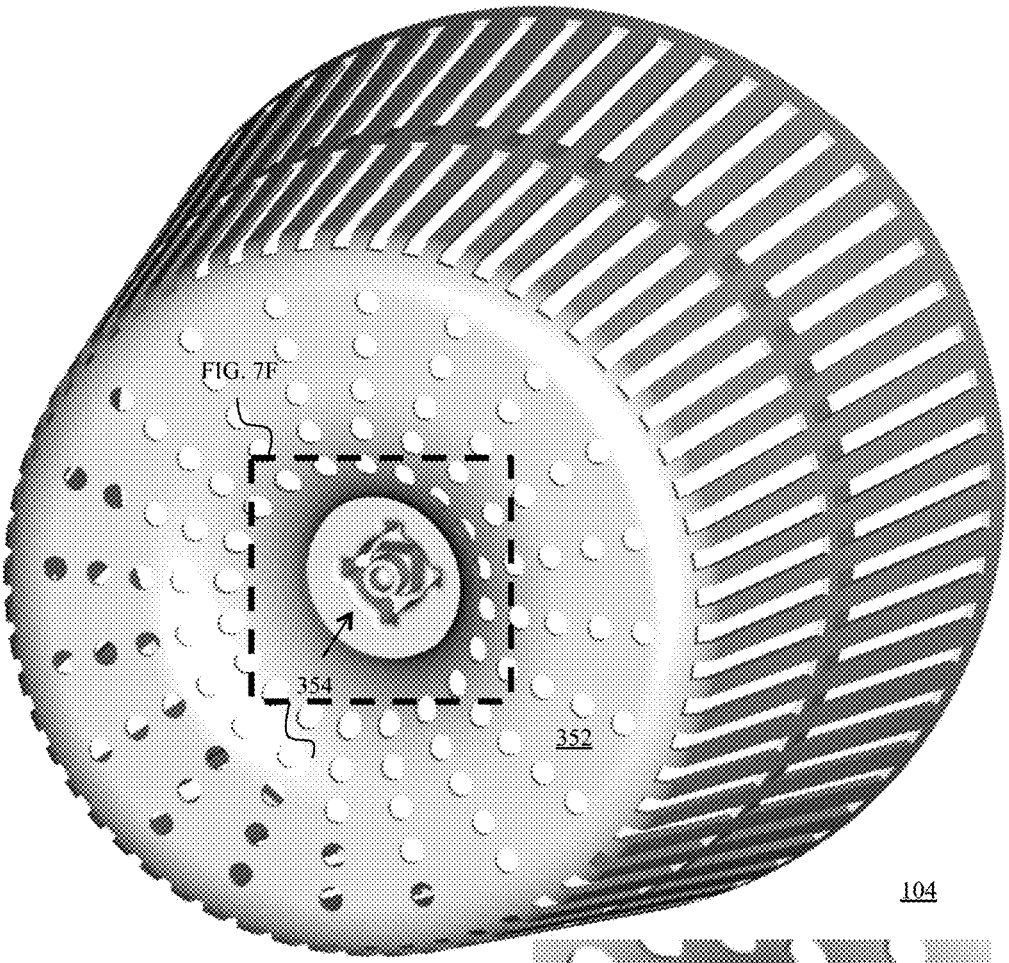
Figure 7F:
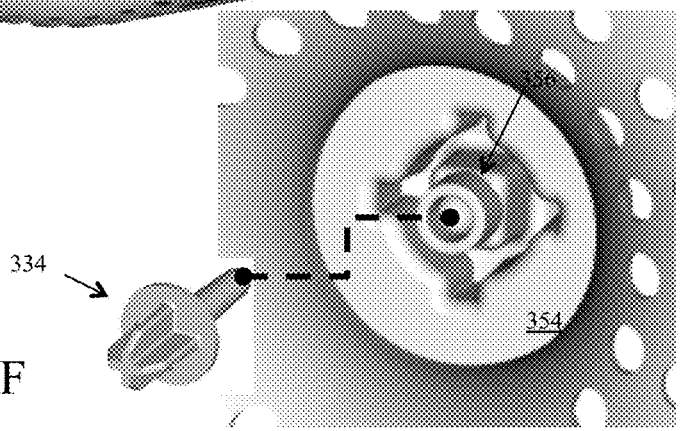
Figure 7G:
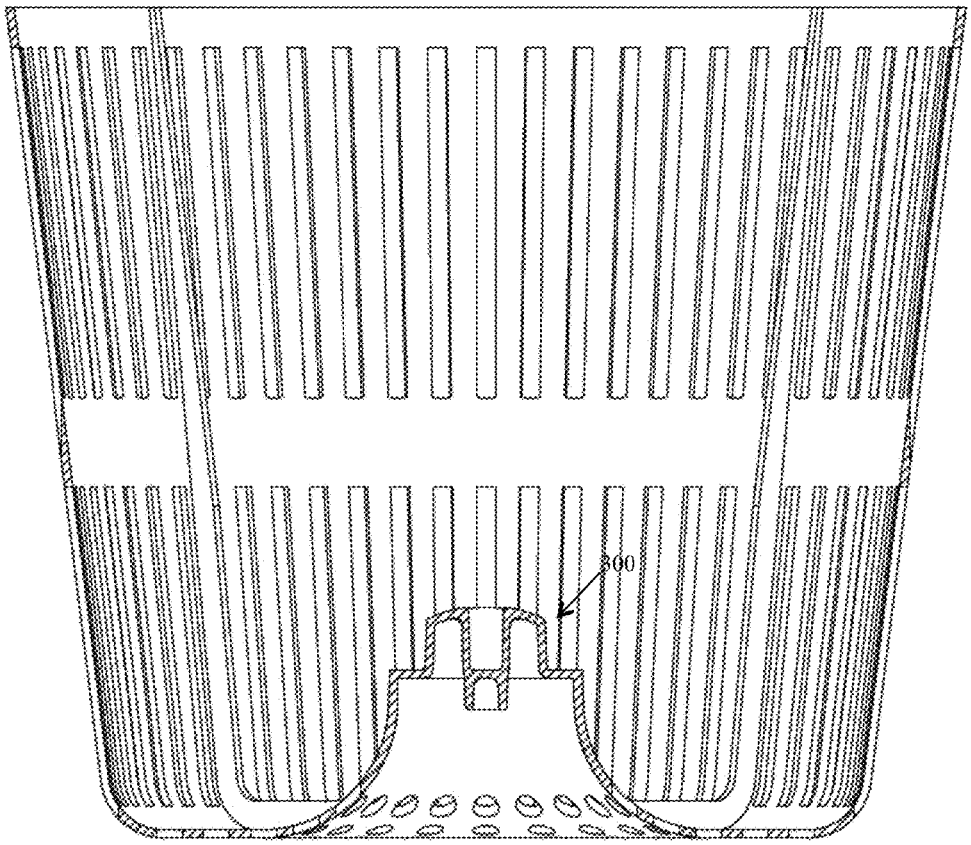

To use manually operated washing machine 100 for first mode of operation for washing laundry, a drain plug 120 (FIGS. 2A and 2B) is first inserted into a drain opening 122 (FIG. 7C) of tub 102, and door 110 is moved to an open position shown along path 128 (FIGS. 1A, 1D, and 1E). Thereafter, desired amount of water and washing soap may be added into manually operated washing machine 100, including laundry from top.

A user may simply close door 110 and seat on top of lid 106, attach handle to wash actuator assembly 124 (detailed below with close-up view shown in FIG. 1L), which defines first position 116, and simply start "cranking" the handle in a back and forth (approximately ¼ turn) motion along path 126 for a desired duration to generate agitating forces to wash laundry. Once completed, a user may simply unplug the drain plug to drain dirty laundry water, and if desired, repeat the above operations for subsequent first mode operations for washes.

Once the wash is completed, and soapy, dirty water is drained out and drain 122 is plugged again, fresh water may be added to the washing machine to commence a rinse cycle to rinse out soap from the laundry. To start the rinse cycle after fresh, clean water is added, the first mode operations is repeated as described above in relation to wash cycle, which agitates laundry to rinse out soapy water. The rinse cycle may be repeated as desired.

Figure 3A:
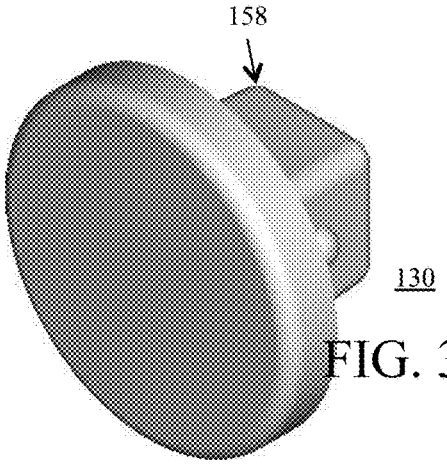
FIGS. 3A to 3C are non-limiting, exemplary illustrations of a cover in accordance with one or more embodiments of the present invention.
Figure 3B:
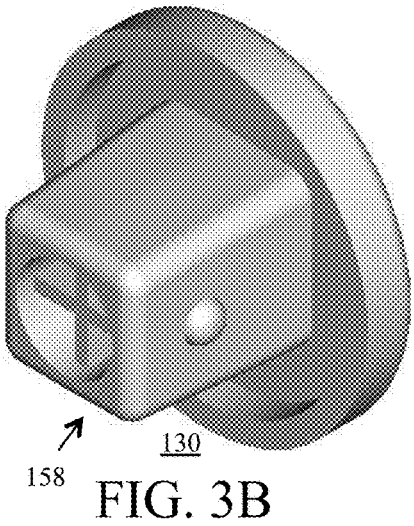
Figure 3C:
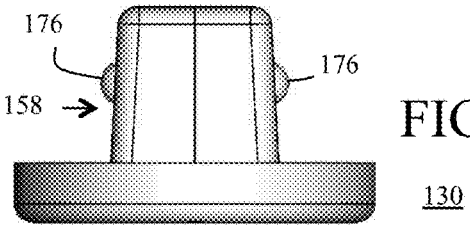

In second mode of operation, the manual washing machine may be used to spin laundry to substantially extract water from washed laundry. To start the spin cycle a cover 130 (FIGS. 3A to 3C) may be removed from the top of a spin actuator assembly 132 (which defines second position 118), with handle 114 detached from wash and rinse actuator assembly 124, and attached to spin actuator assembly 132, and unlocked.

Handle 114 is commonly known and is referred to as "spin mop" handle, and includes a well known a spiral drive mechanism (e.g., an internal fluted rod) including an adjustable length that varies along a longitudinal axis of handle 114. The adjustable length of handle 114 is contracted (or compressed) in length and locked when associated with tub 102 at first position 116 during first mode of operation (wash and rinse cycles).

The adjustable length of handle 114 is extended in length and unlocked and free to move axially along the longitudinally axis of the handle (moved up/down) when associated with tub 102 at second position 118 during second mode of operation (water extraction cycle) to generate a spinning motion. As indicated, handle 114 is well known and in fact, most devices where longitudinally axial motion a device generates a rotational motion at its distal end may be used as a handle to facilitate in the spinning motion for spin cycle (second mode of operation).

Nonetheless, once handle 114 is detachably connected with spin actuator assembly 132, axial actuation 134 of handle 114 translates into a rotational motion 136 of its end, which spins spin actuator assembly 132 to spin basket 104 (detailed below). That is, the well known spiral drive mechanism of handle 114 rotates 136 an end of handle 110 to rotate spin actuator assembly 132 in one direction, which, in turn, actuates power transfer assembly 138 to spin basket 104 in one direction.

Figure 7H:
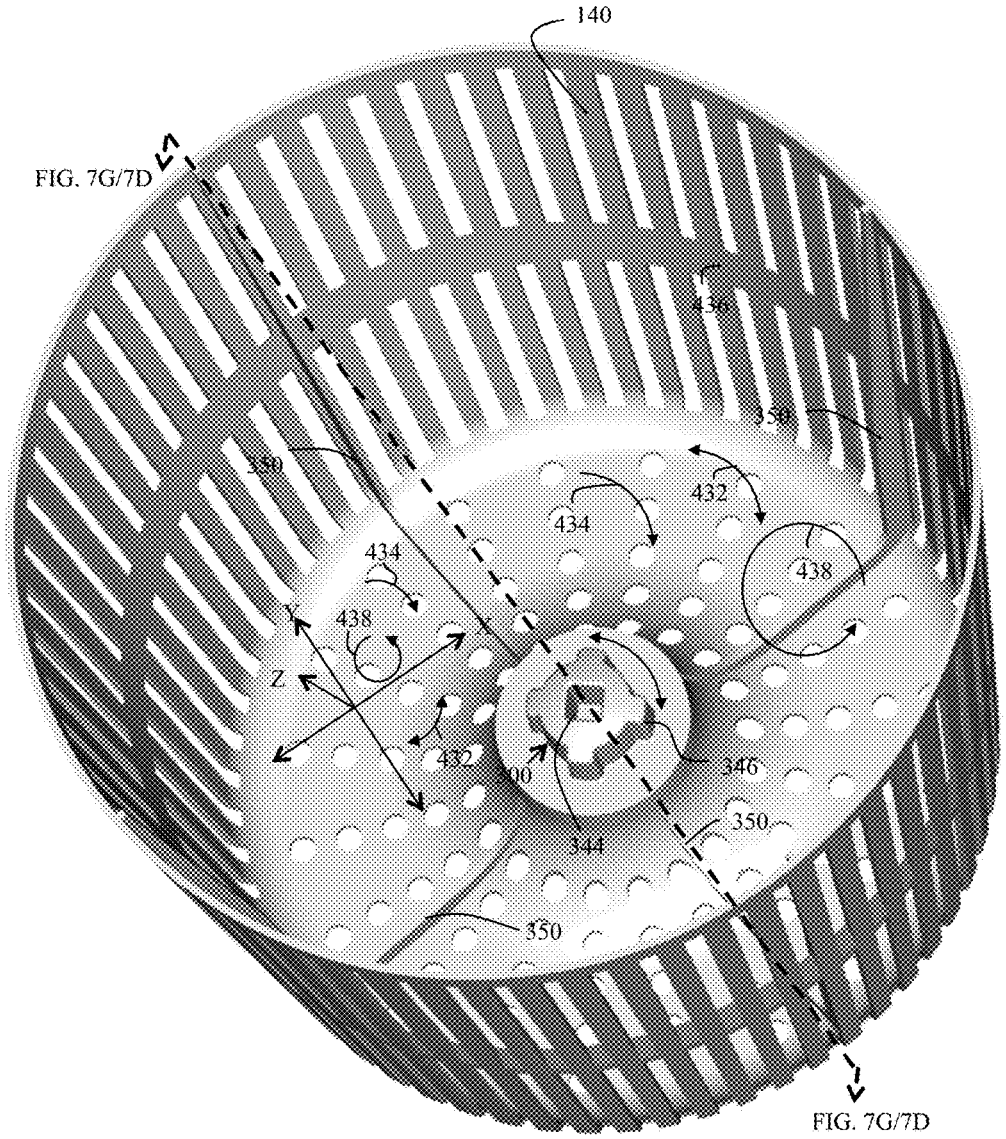
Figure 7I:
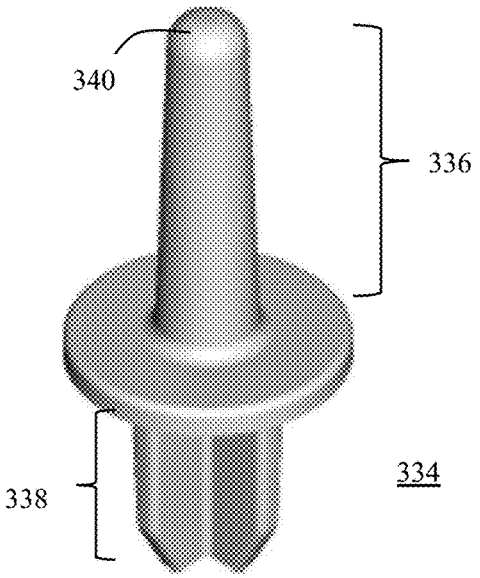
Figure 7J:
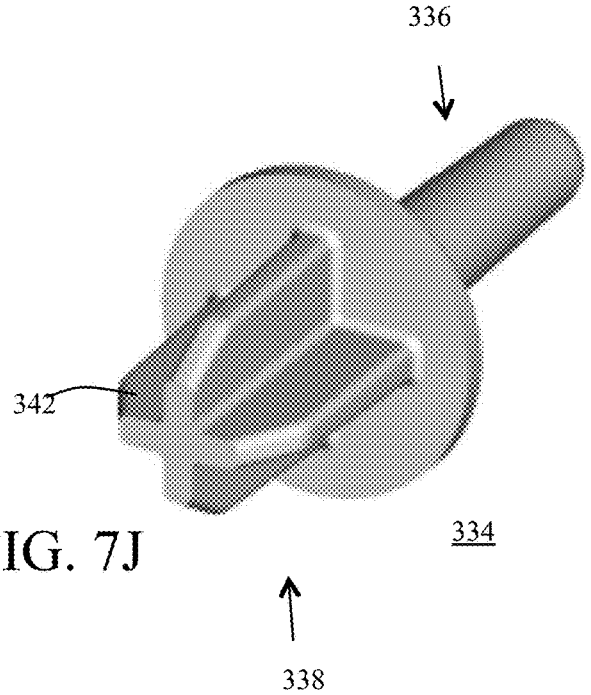

The spinning of basket 104 generates a centrifugal force that move laundry and water towards inner walls 140 (FIG. 7H) of basket 104, with water moved into tub 102 and drained (once drain plug 120 is unplugged). The second mode of operation (spin cycle operations) may be repeated as often as desired to substantially extract water from clothing.

Figure 4A:
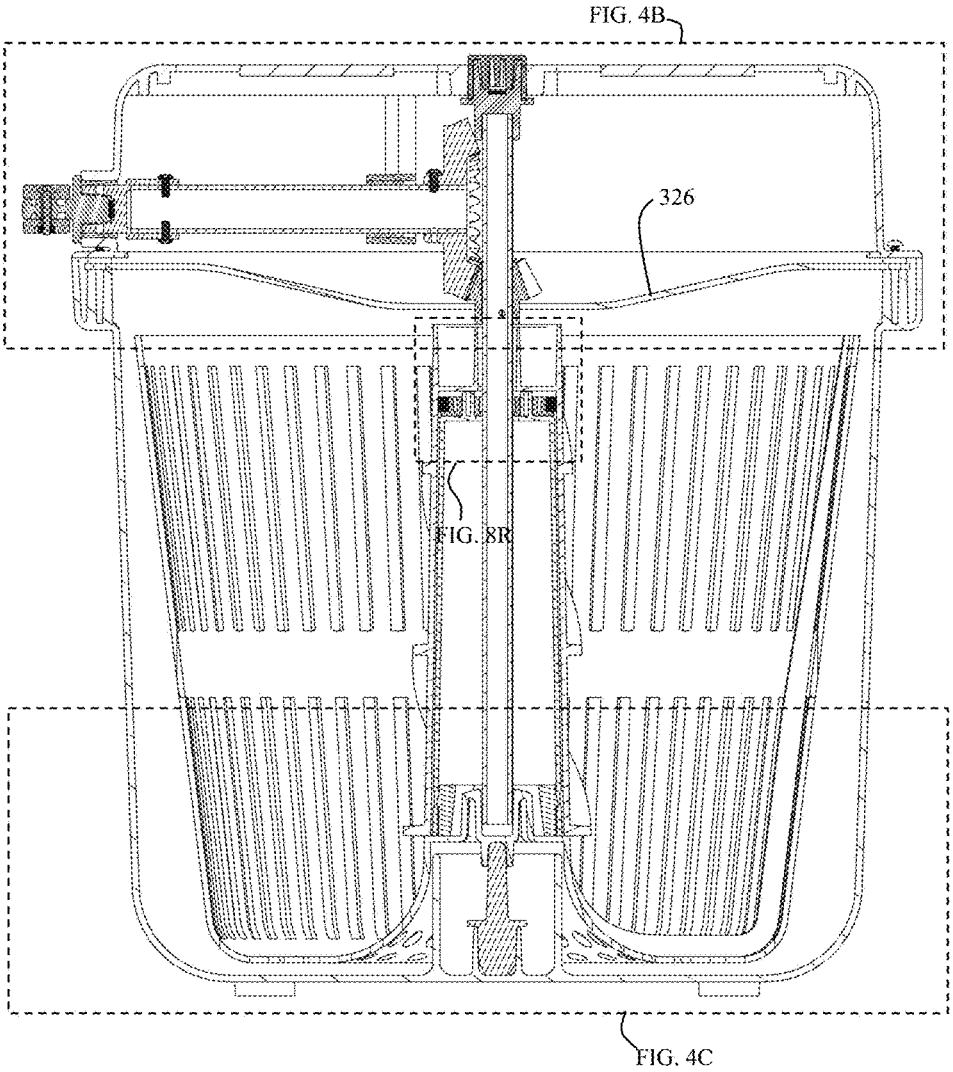
FIGS. 4A to 4C are non-limiting, exemplary cross-sectional views of manually operated washing machine shown in FIGS. 1A to 3C in accordance with one or more embodiments of the present invention.
Figure 4B:
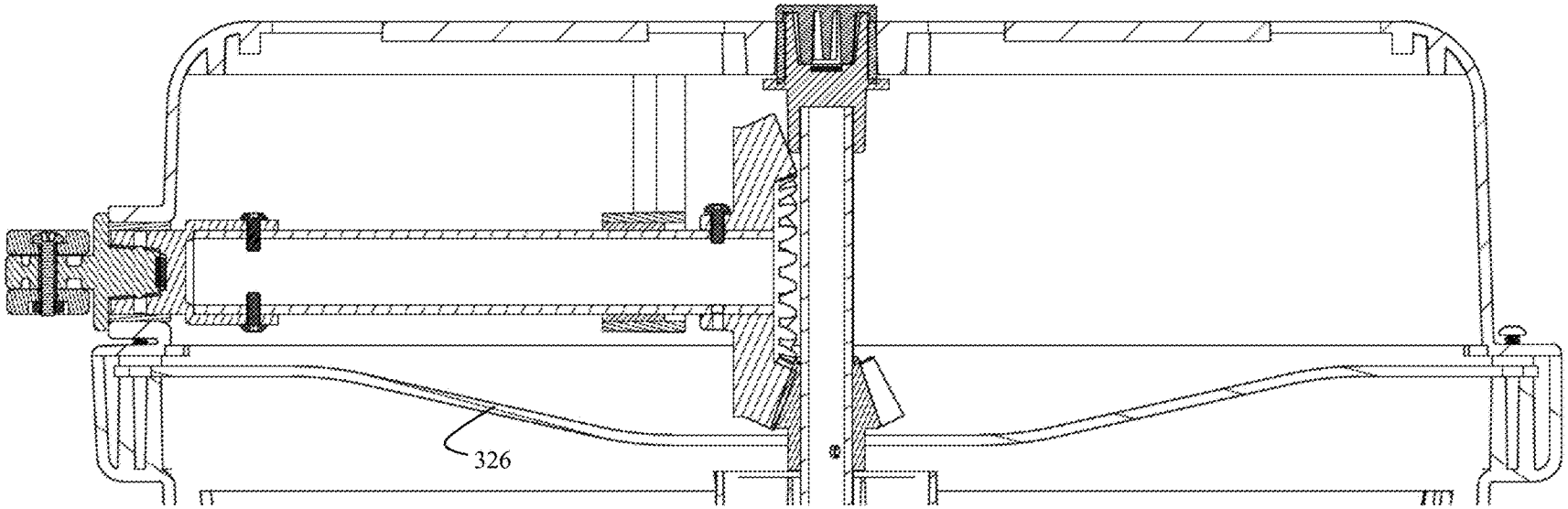
Figure 4C:
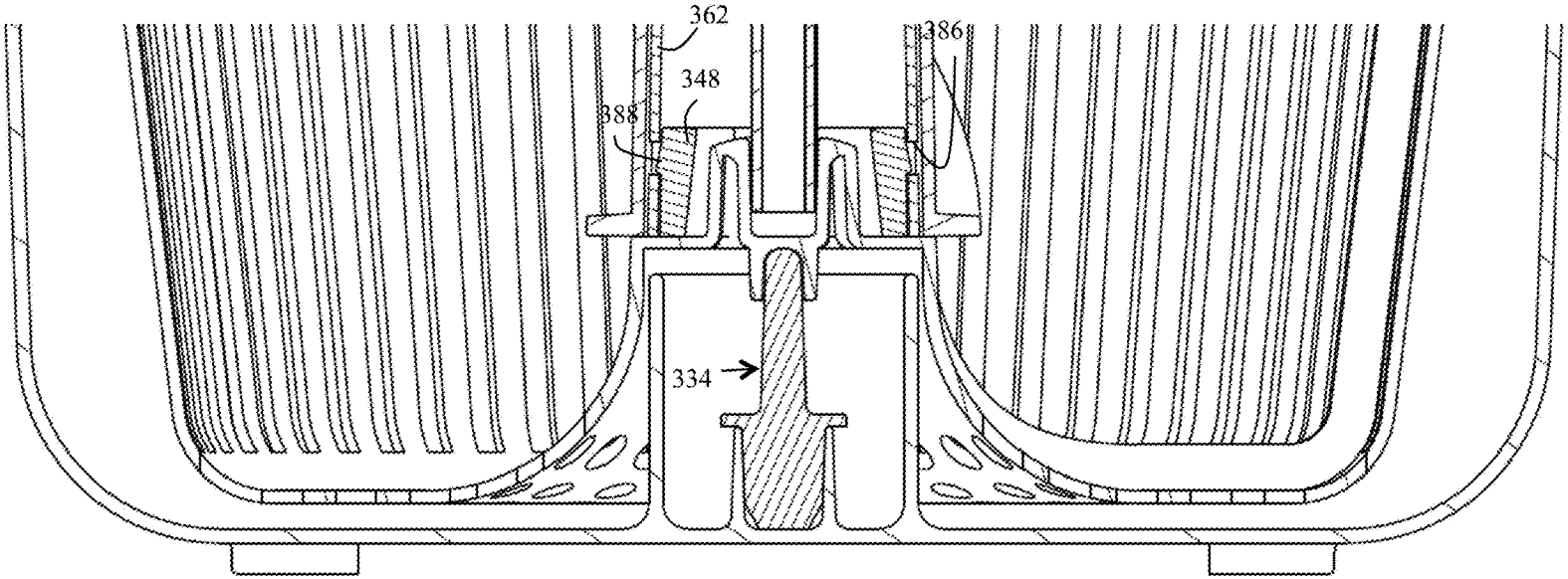
Figure 5A:
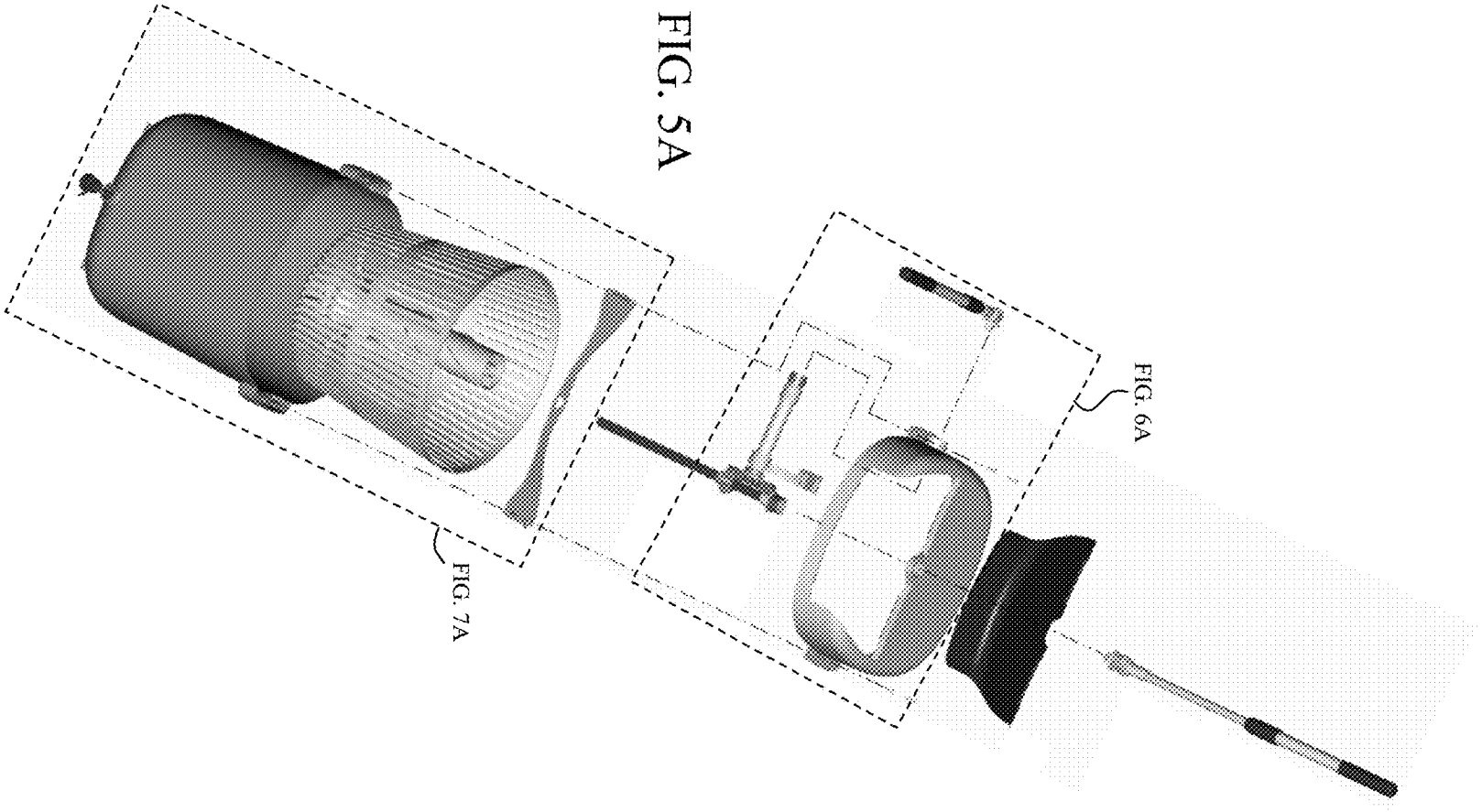
FIGS. 5A and 5B are non-limiting exemplary exploded views illustrations of the various components of the manually operated washing machine show in FIGS. 1A to 4C in accordance with one or more embodiments of the present invention.
Figure 5B:
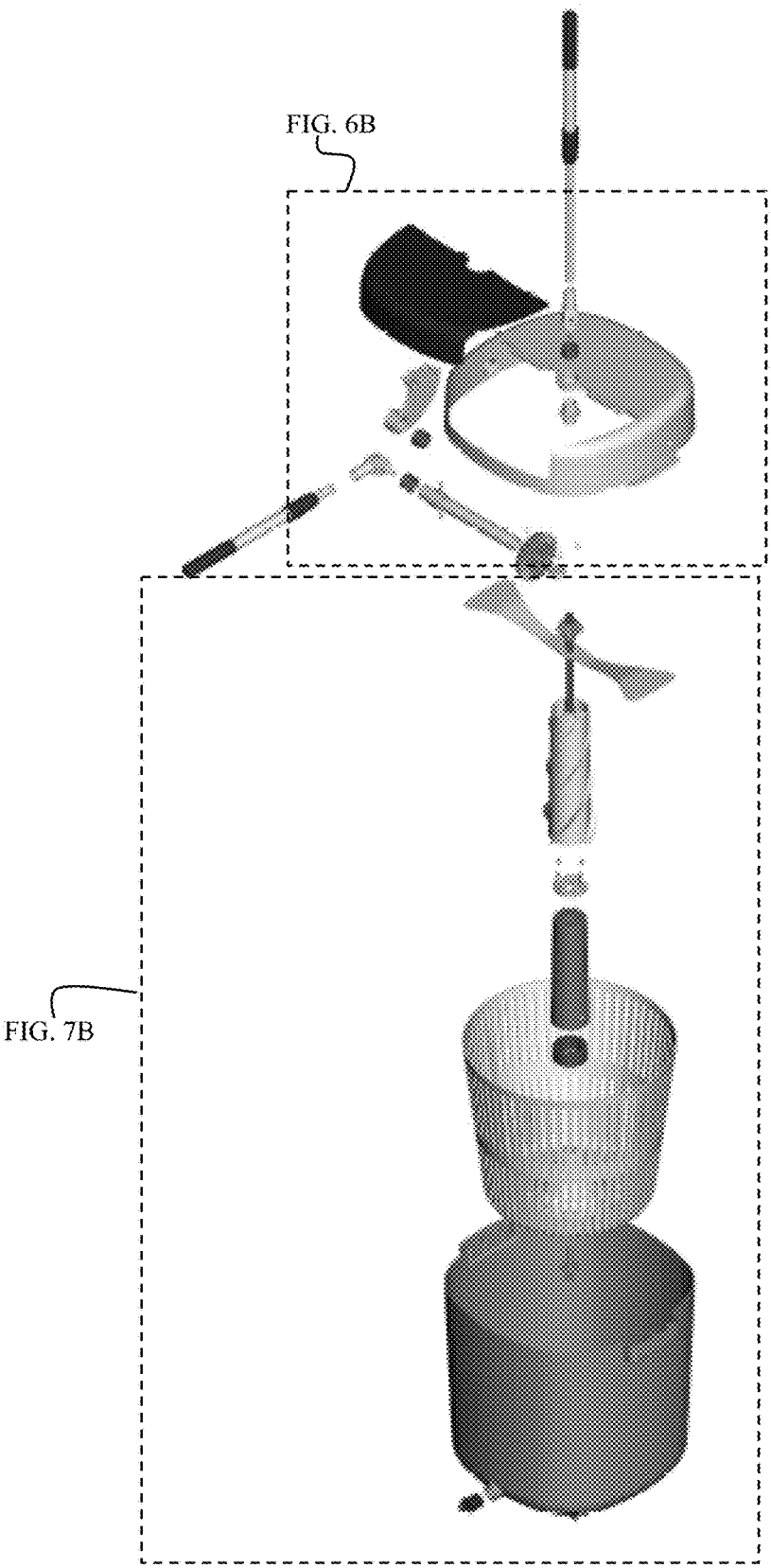

FIGS. 4A to 4C are non-limiting, exemplary cross-sectional views of manually operated washing machine shown in FIGS. 1A to 3C in accordance with one or more embodiments of the present invention. FIGS. 5A and 5B are non-limiting exemplary exploded views illustrations of the various components of the manually operated washing machine in accordance with one or more embodiments of the present invention. The exploded views shown in FIGS. 5A and 5B illustrate disassembled, separated components that show the cooperative working relationship, orientation, positioning, and exemplary manner of assembly of the various components of the manually operated washing machine in accordance with one or more embodiments of the present invention, with each component detailed below.

Figure 6A:
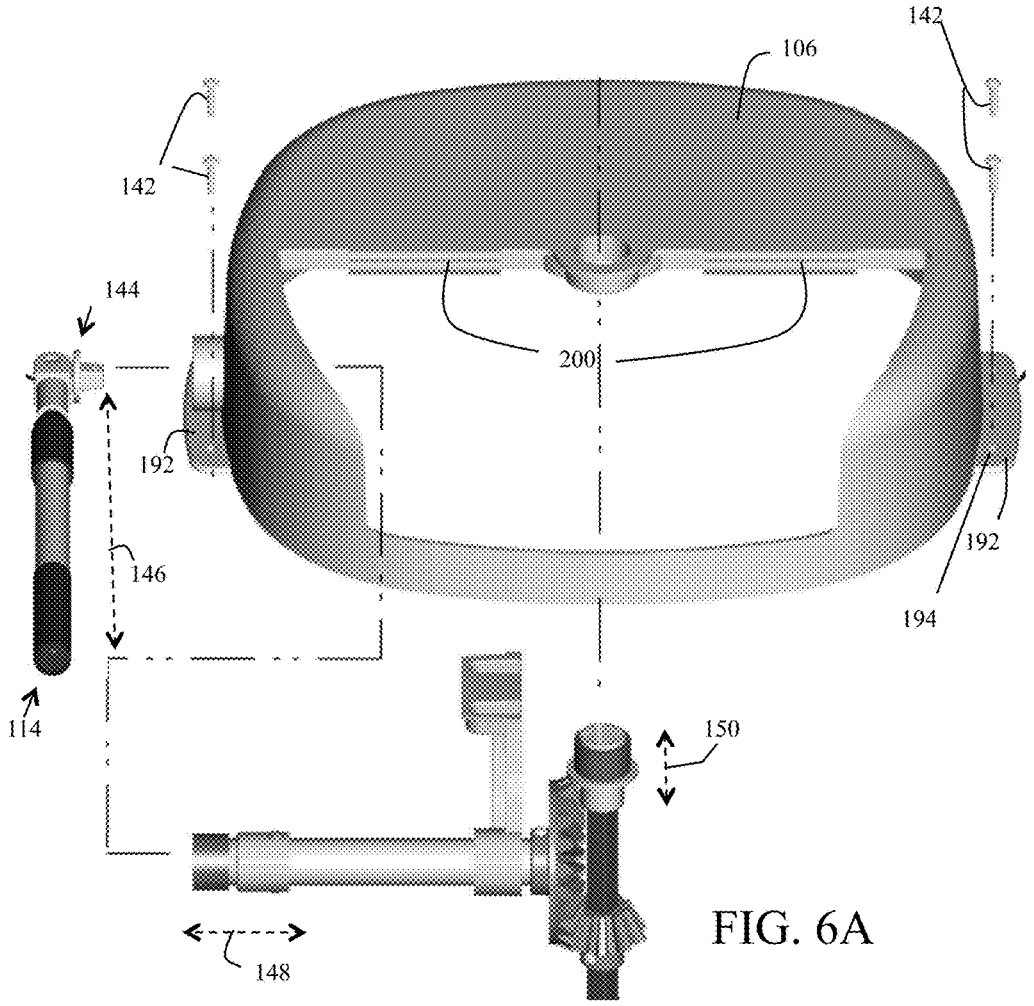
FIGS. 6A to 6X are non-limiting, exemplary illustrations of a mechanical drive system for generating a wash and rinse cycle of the manually operated washing machine shown in FIGS. 1A to 5B in accordance with one or more embodiments of the present invention.
Figure 6B:
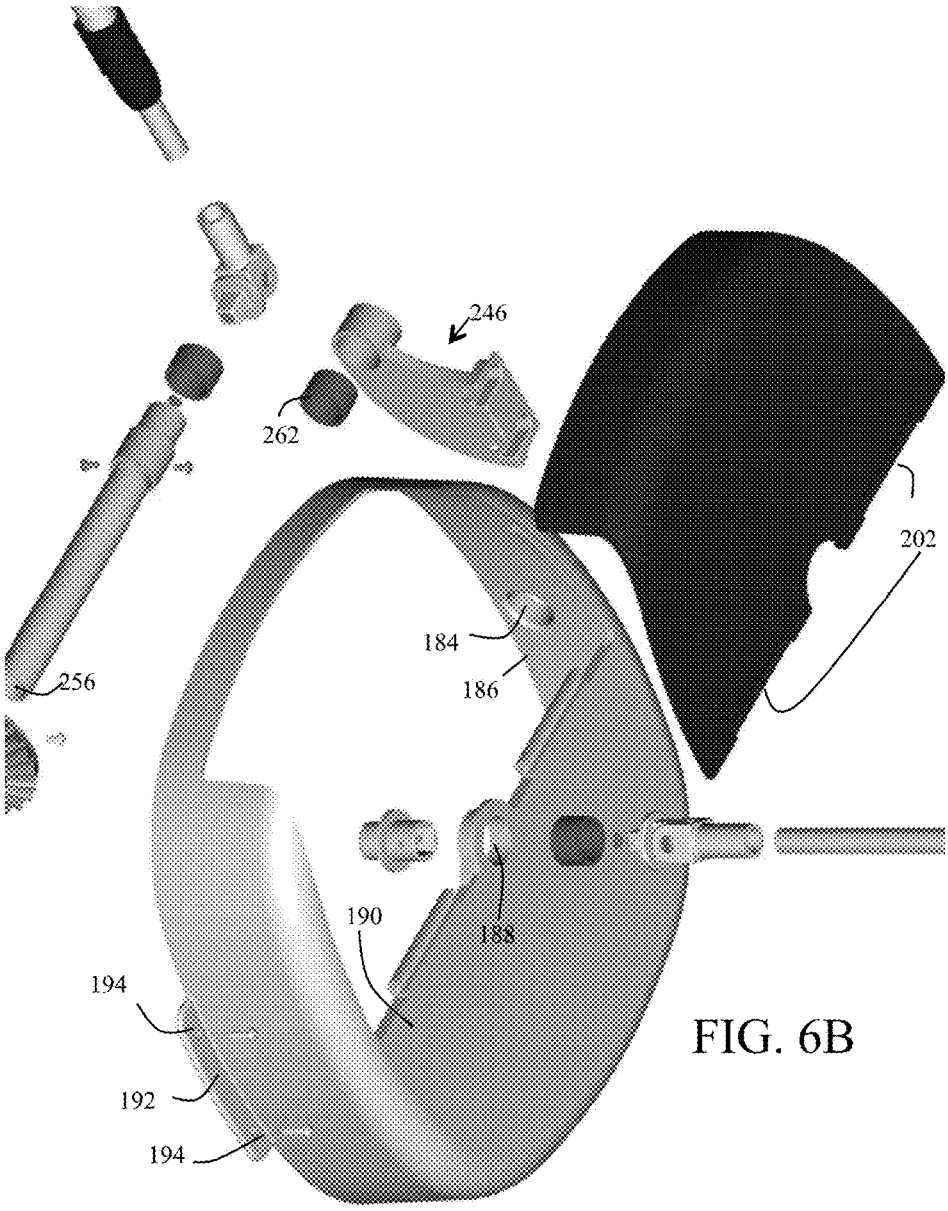
Figure 6C:
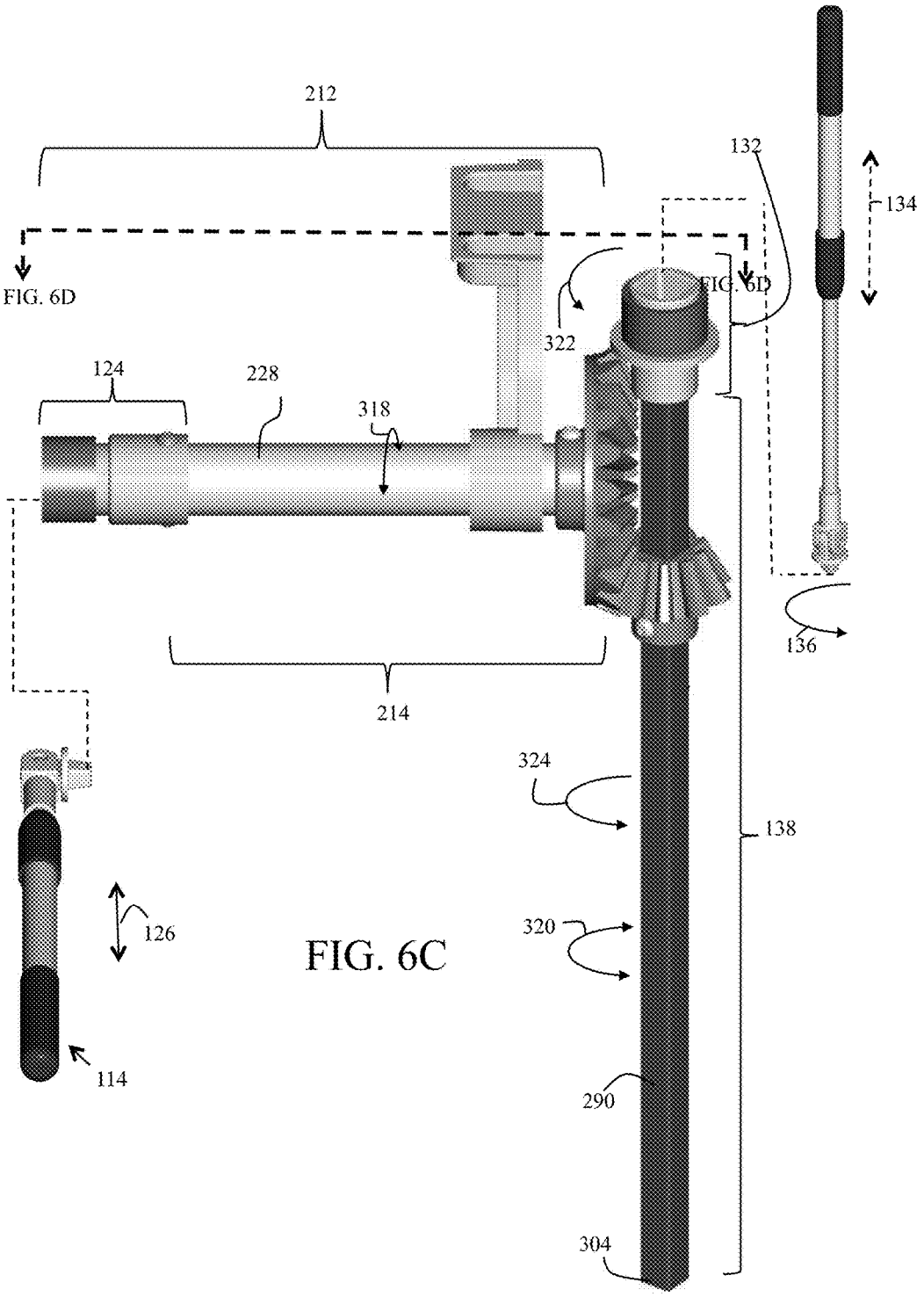
Figure 6D:
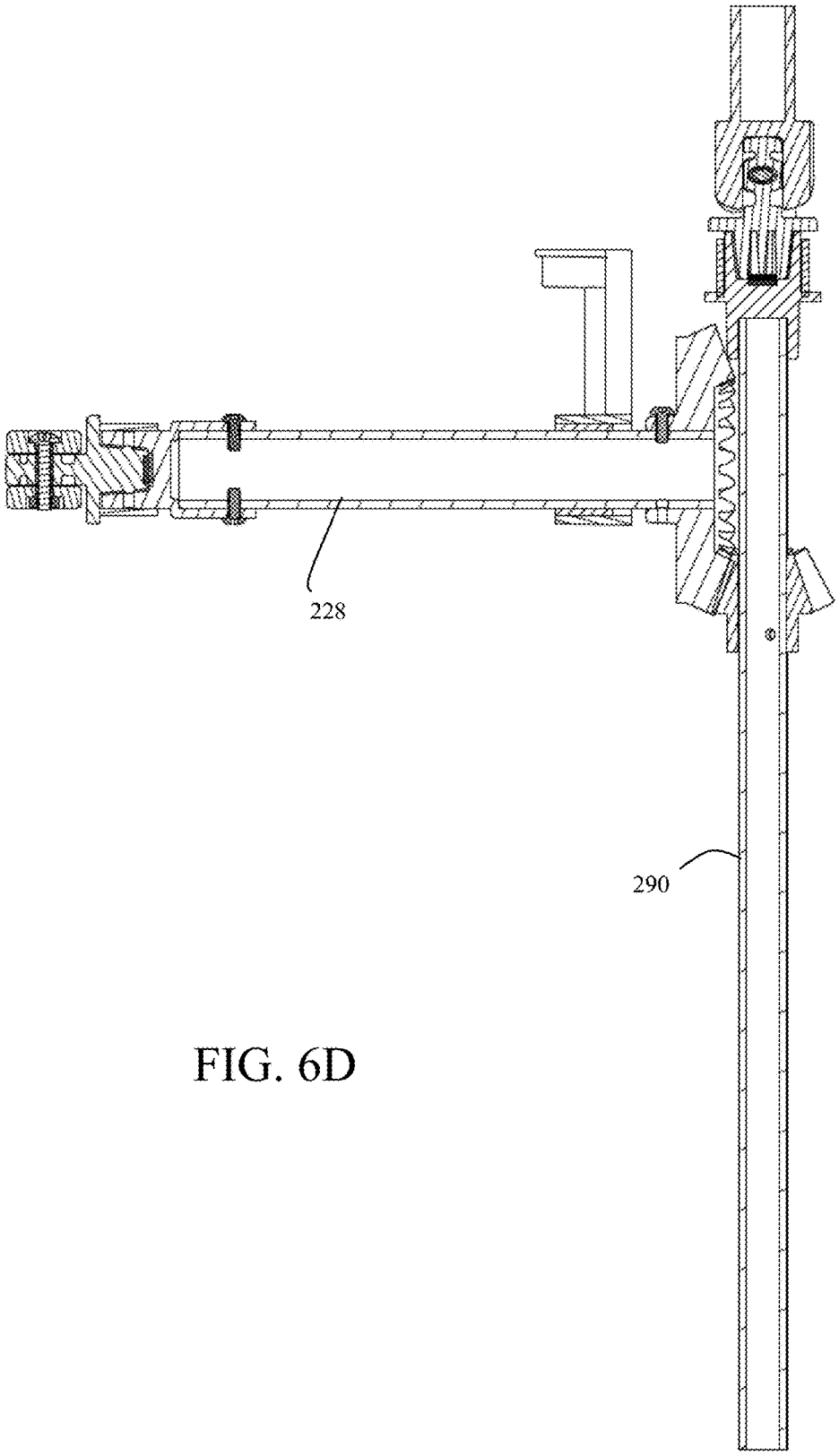
Figure 6E:
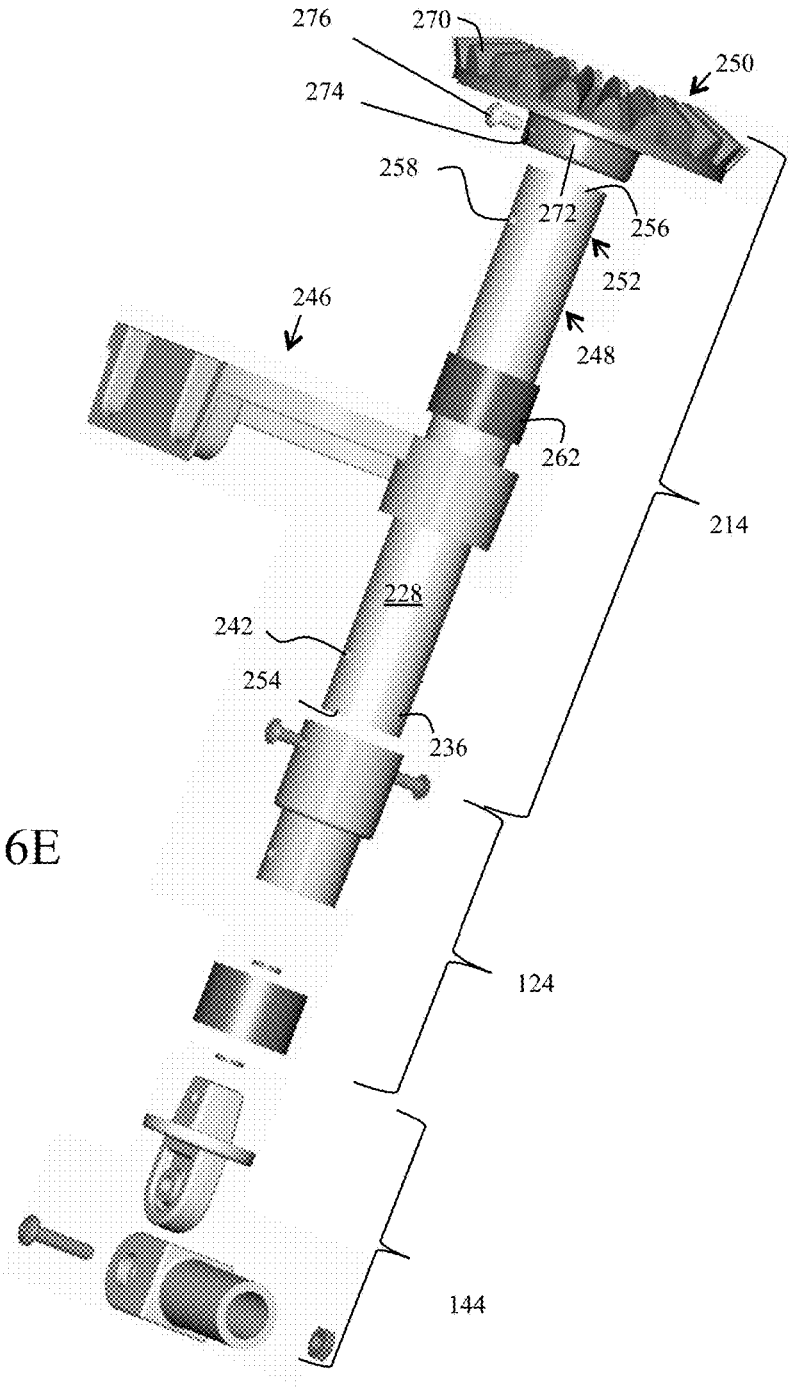
Figure 6F:
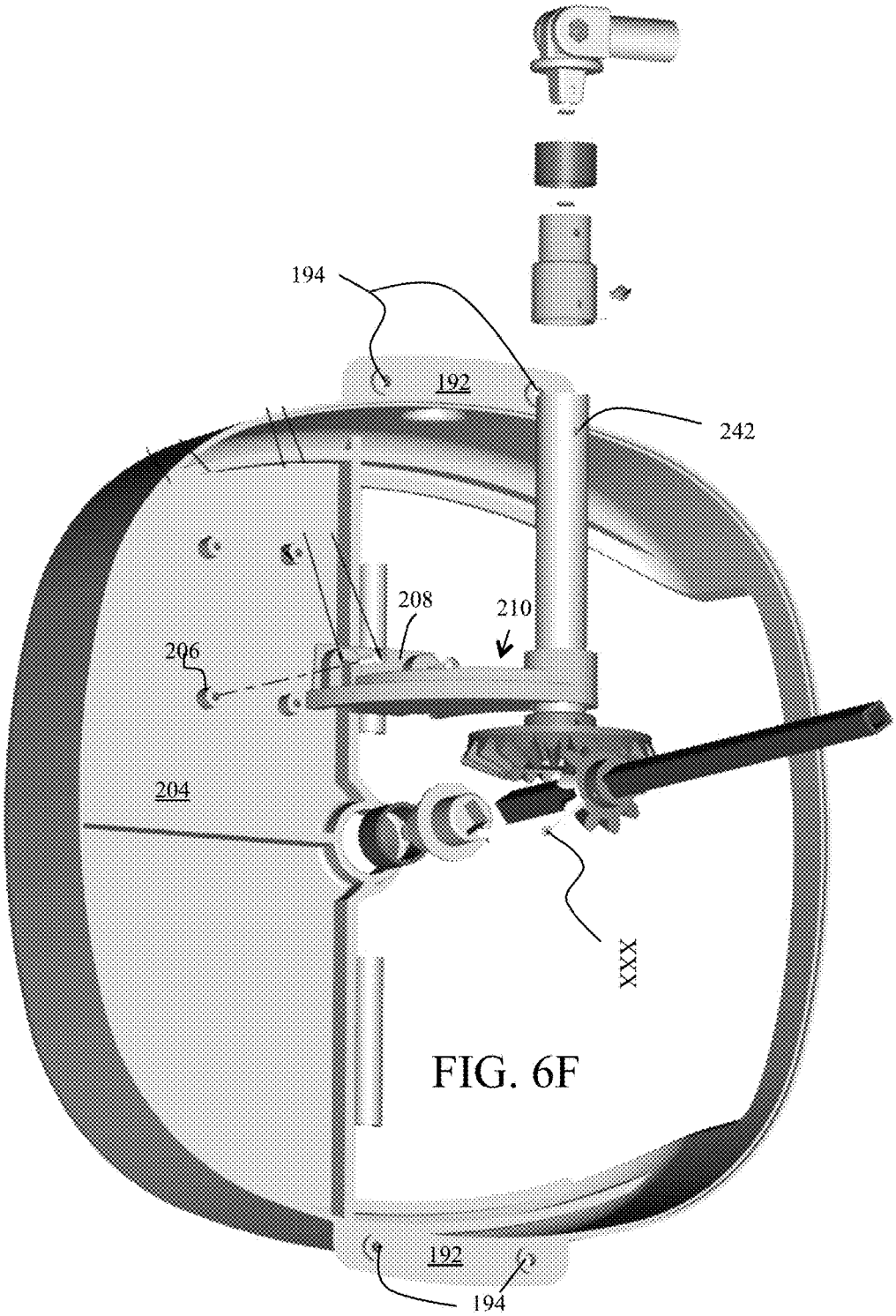
Figure 6G:
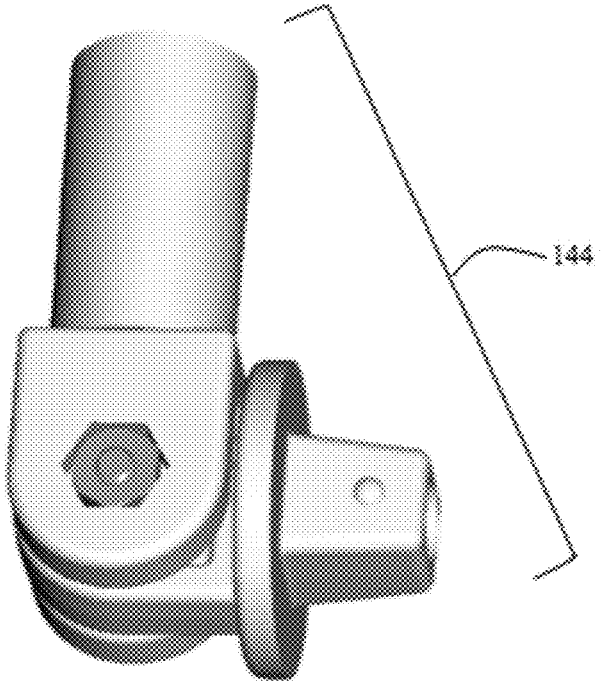
Figure 6H:
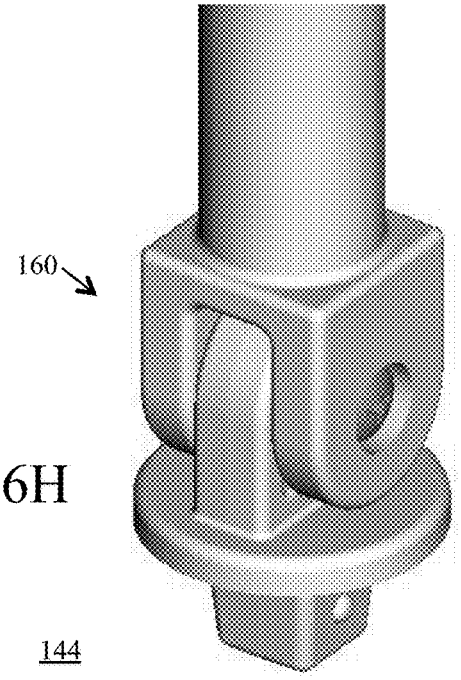
Figure 6I:
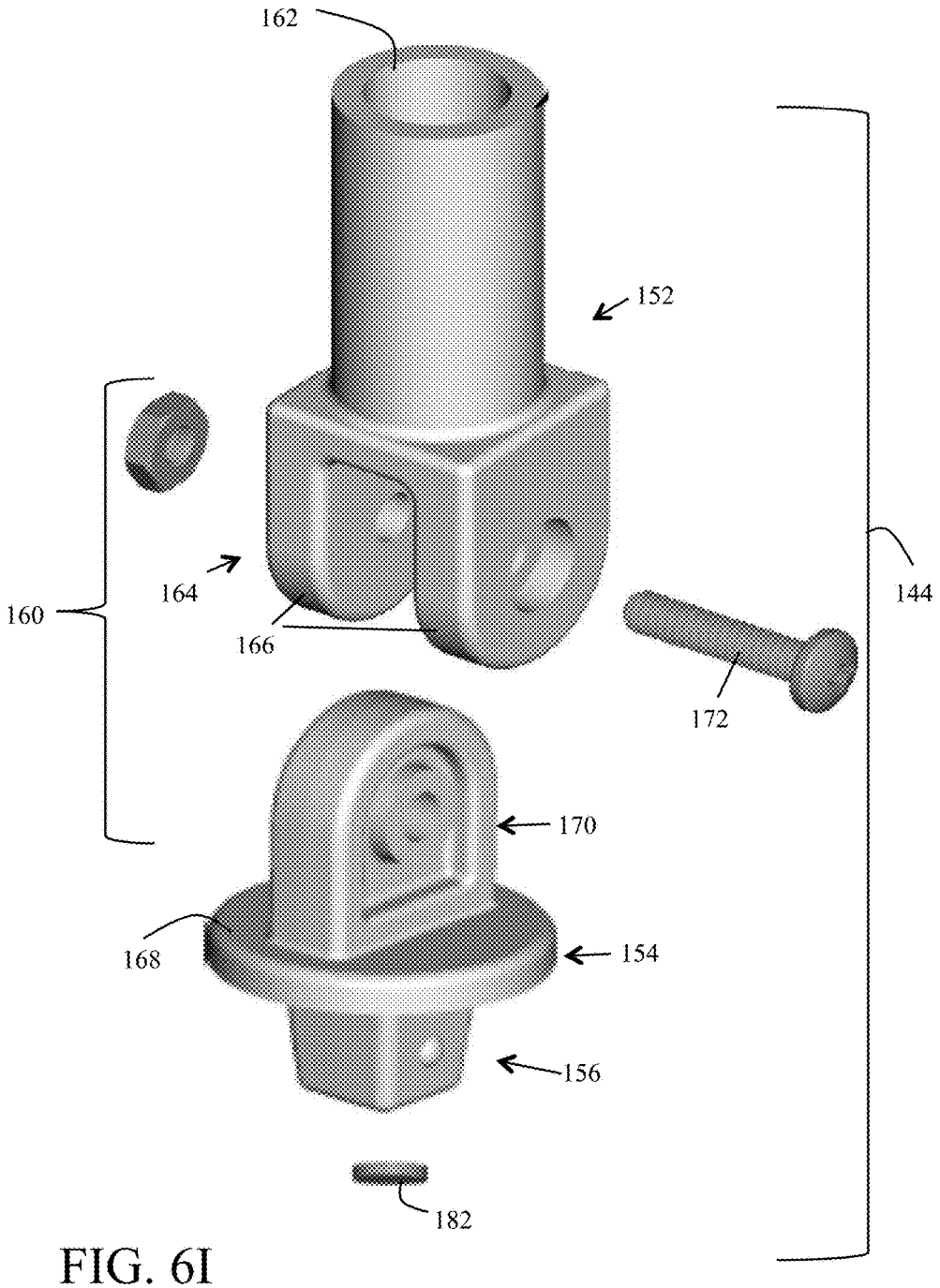
Figure 6J:
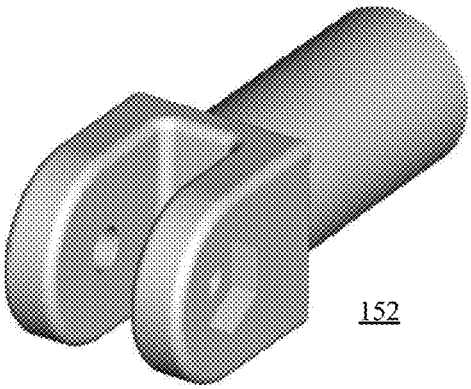
Figure 6K:
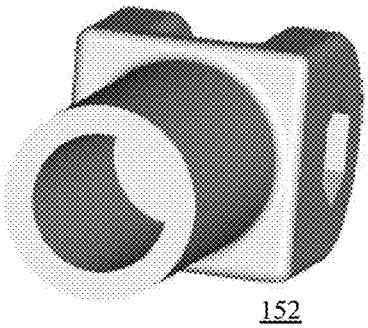
Figure 6L:
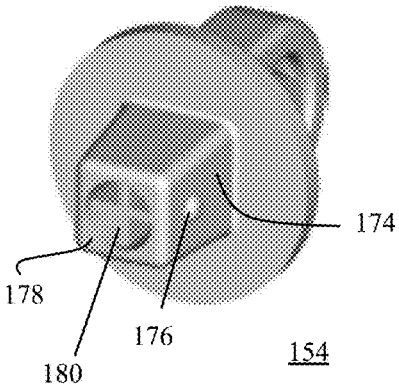
Figure 6M:
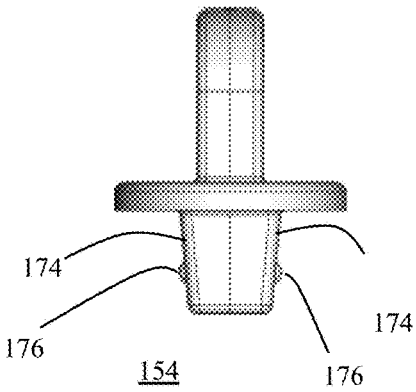
Figure 6N:
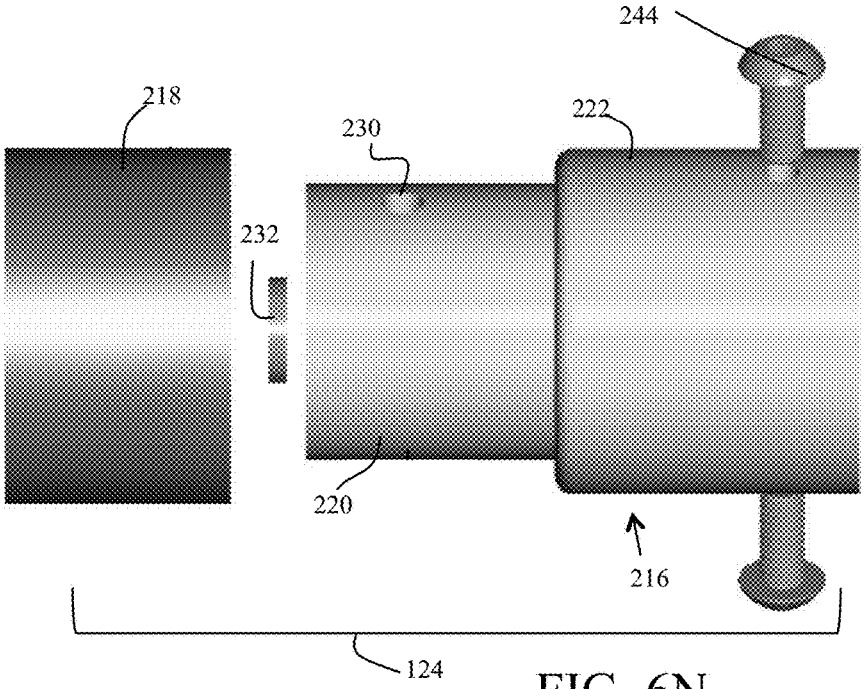
Figure 6O:
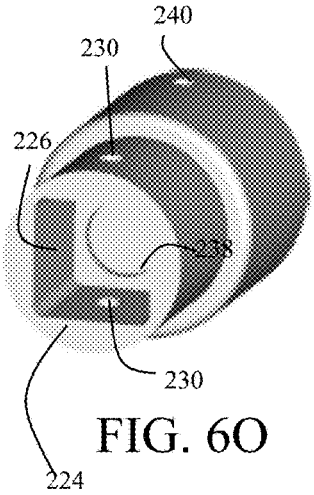
Figure 6P:
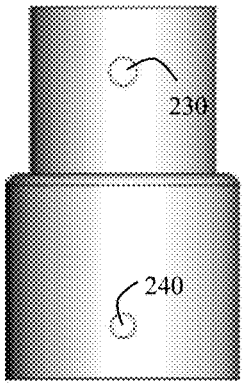
Figure 6Q:
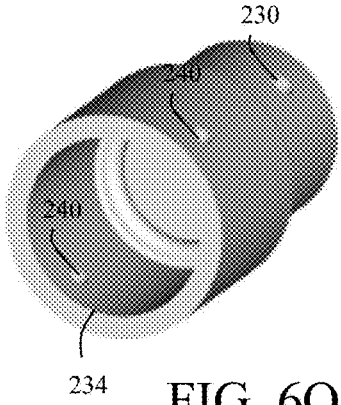
Figure 6R:
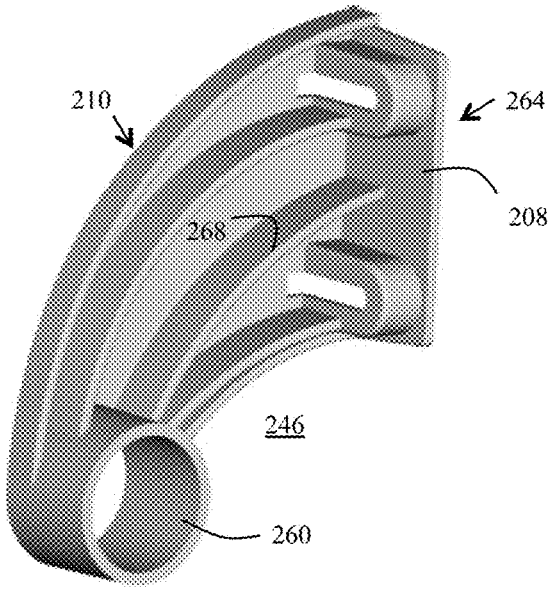
Figure 6S:
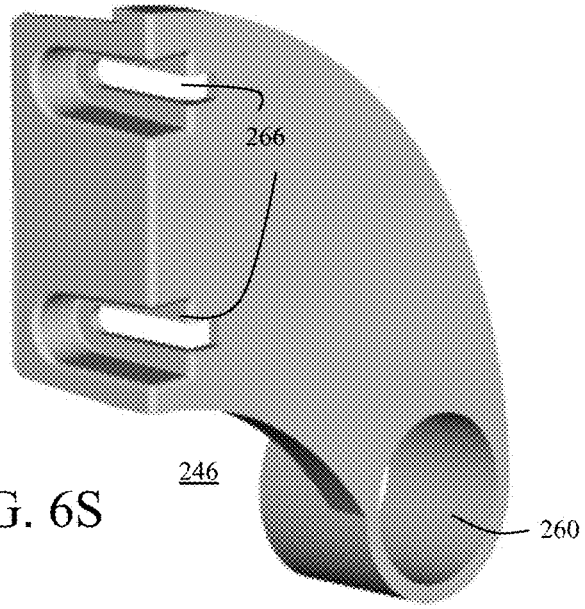
Figure 6T:
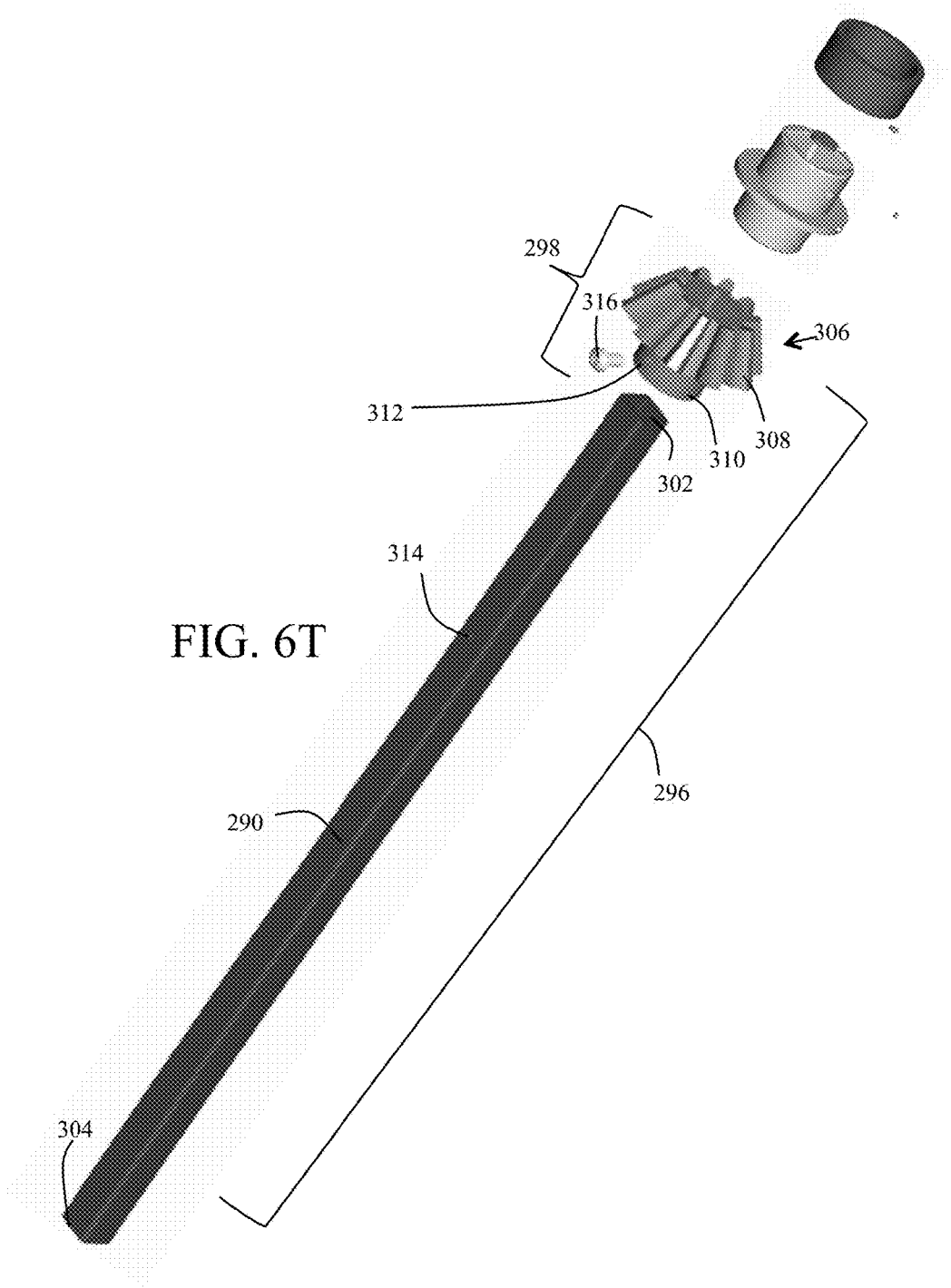
Figure 6U:
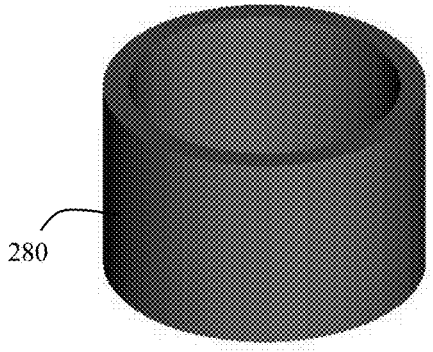
Figure 6V:
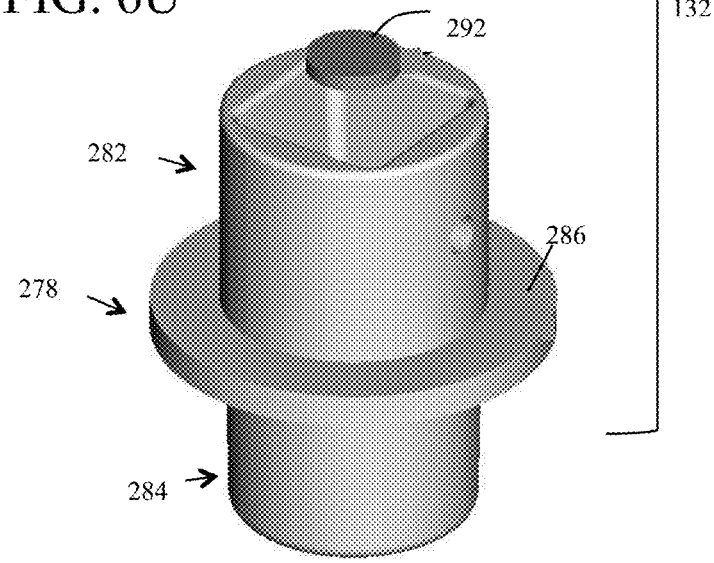
Figure 6V:
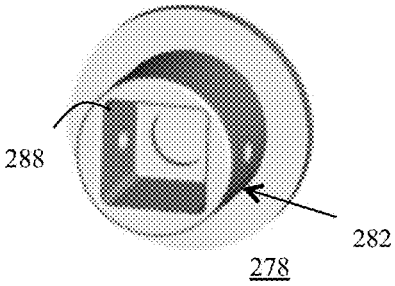
Figure 6W:
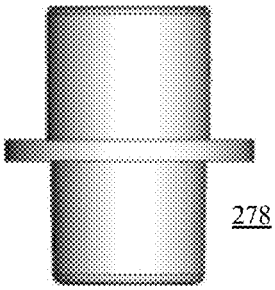
Figure 6X:
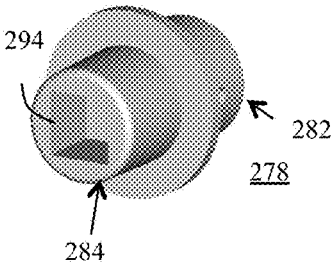

FIGS. 6A to 6X are non-limiting, exemplary illustrations of a mechanical drive system for generating a first mode (wash and rinse) and a second mode (spin) operations of manually operated washing machine shown in FIGS. 1A to 5B. As illustrated in FIGS. 1A to 6X and further detailed below, all components from lid 106 and door 110 to basket 104 (with the exception of handle 114) may first be assembled together and then placed within tub 102, with lid 106 finally secured to tub 102 by a set of fasteners 142, providing easy assembly and manufacturing.

As illustrated, handle 114 is attached to an engagement adapter 144 (best shown in FIGS. 6G to 6M), which enables handle 114 to detachably connect with either wash and rinse or spin cycle actuator assemblies 124 and 132. Handle 114 is fixed to a detachable engagement adapter 144 that detachably engages wash and rinse actuator assembly 124 during wash cycle, with a longitudinal axis 146 of handle 114 perpendicular a longitudinal axis 148 of wash and rinse actuator assembly 124. Engagement adapter 144 detachably engages a spin actuator assembly 132 during spin cycle, with longitudinal axis 146 of handle 114 being axial with a longitudinal axis 150 of spin actuator assembly 132.

Engagement adapter 144 is comprised of a receiver member 152 that detachably secures a rod of handle 114, and an engagement member 154 that detachably engages one of wash and rinse cycle actuator assembly 124 and spin cycle actuator assembly 132. It should be noted that engaging end 156 (detailed below) of engagement member 154 of engagement adapter 144 is identical to engaging end 158 of cover 130.

Receiver member 152 is moveably coupled with engagement member 154. Receiver member 152 is coupled with engagement member 154 by hinge joint 160, which permit motion of receiver member 152 in relation to engagement member 154 in only one plane. The motion is not a "loose" one in that hinge joint 160 has tight tolerances. Receiver member 152 is comprised of a cylindrical bore 162 that receives the rod of handle 114, and an integral yoke 164 that comprise lateral hinge barrels 166 of hinge joint 160 for coupling receiver member 152 with engagement member 154.

Engagement member 154 is comprised of a cover-support (a disc structure 168) having a receiver side and an engaging side. Engagement member 154 further includes a center hinge barrel 170 that protrudes from the receiver side of cover-support 168. Center hinge barrel 170 is coupled in between with lateral hinge barrels 166 by a hinge pin 172, which may comprise of a bolt/nut connector as shown.

Engagement member 154 further includes an engaging end 156 that protrudes from the engaging side of cover-support 130. Engaging end 156 is configure as a frustum of polygonal (quadrilateral is preferred) pyramid, with sides 174 of the quadrilateral pyramid having interlocking or inter-latching protuberances 176 to interlock or latch with one of wash and rinse or spin actuator assembly 124 and 132. Engaging end 156 has a free distal end 178 that includes a compartment 180 that houses a first retention mechanism 182, a non-limiting example of which may include a disc magnet (e.g., a rare earth magnet).

As further illustrated, lid 106 includes a wash and rinse cycle opening 184 at a side 186, which defines first position 116, and a spin cycle opening 188 at a top side 190, which defines second position 118. Lid 106 further includes lateral handles 192 with openings 194 that fix lid 106 onto openings 196 of lateral handles 198 of tub 102 by fasteners 142. Lid 106 further includes hinge flanges 200 that snap into hinge recesses 202 of door 110. An underside 204 of lid 106 includes mounting bosses 206 for securing second end 208 of support adapter 210 (detailed below), which also facilitates assembling all components together prior to connection with tub 102.

Manually operated washing machine 100 provides a wash and rinse cycle drive system 212 comprised of wash and rinse cycle actuator assembly 124 and a wash and rinse cycle drive assembly 214, which when actuated by handle 114, ultimately generate one or more agitation forces to agitate and wash clean laundry. Wash and rinse cycle drive system 212 is oriented perpendicular a longitudinal axis of manually operated washing machine 100 (same orientation as height 110). Wash and rinse cycle actuator assembly 124 (FIGS. 6N to 6Q) include a first intermediate power transfer member 216 and a first busing 218, with first intermediate power transfer member 216 comprising a first power receiver portion 220 and a first power transfer portion 222.

First power receiver portion 220 of first intermediate power transfer member 216 is comprised of a hollow cylinder 224 with opening 238 with polygonal preferably, quadrilateral internal structure 226. The internal structural 226 configuration is commensurate with engaging end 156 of engagement member 144 to receive, mate (or engage) and enable transfer of power from handle 114 to wash and rinse cycle drive shaft 228. First power receiver portion 220 has an outer cylindrical circumference with a lateral openings 230 that receives interlocking protuberances 176 of engaging end 156 of engagement member 144. First power receiver portion 220 houses a second retention mechanism 232 (in a form of a disc magnet) that engages with first retention mechanism 182 of engaging end 156 of engagement member 144.

First power transfer portion 222 of first intermediate power transfer member 216 is comprised of a hollow cylinder with a larger second opening 234 (larger than first opening 238) for receiving a distal end 236 of wash and rinse cycle drive shaft 228. First power transfer portion 222 further includes a lateral opening 240 that are aligned with lateral opening 242 of wash and rinse cycle drive shaft 228 (near distal end 236), with lateral openings 240 of power transfer portion 222 and openings 242 wash and rinse cycle drive shaft 228 used to secure power transfer portion 222 with wash and rinse cycle drive shaft 228 using fasteners 244.

As indicated above, wash and rinse cycle drive system 212 is also comprised of a wash and rinse cycle drive assembly 214 (FIG. 6E). Wash and rinse cycle drive assembly 214 includes a wash and rinse cycle drive shaft 228 with a first distal end 236 connected to wash and rinse cycle actuator assembly 124.

Wash and rinse cycle drive assembly 214 further includes a wash and rinse cycle support assembly 246 associated with near a second end 248 of wash and rinse cycle drive shaft 228, and a wash and rinse cycle drive gear 250 associated a second distal end 252 of wash and rinse cycle drive shaft 228. Wash and rinse cycle drive shaft 228 is comprised of a hollow cylindrical tube with first and second openings 254 and 256, and with lateral openings 258 near distal end 252.

Wash and rinse cycle support assembly 214 (FIGS. 6R and 6S) is comprised of support adapter 246 with a first end 260 that receives a busing 262 and wash and rinse cycle drive shaft 228, and a second end 264 that is secured to an interior side 204 of lid 106. Second end 264 is comprised of a base 208 of sufficient expanse for preventing translational movement of support adapter body 210, base 208 includes two longitudinally extending, recessed grooved slots 268 that receive mounting bosses 206 of lid 106.

It should be noted that without support adapter 246, wash and rinse cycle drive shaft 228 would be cantilevered on wash cycling opening 184 at side 186 of lid 106. Therefore, support adapter 246 functions as a secondary support for wash and rinse cycle drive shaft 228 to prevent wobbling of wash and rinse cycle drive shaft 228. Support adapter 246 includes a body 210 between first and second ends 260 and 264 thereof to extend its reach between the distance of drive shaft 228 and lid 106, and includes stiffener ribs 268 to improve structural integrity of support adapter 246.

Wash and rinse cycle drive gear 250 is comprised of a beveled gear with cogs 270 and a hollow cylindrical connection end (the gear hub) 272 that receives second distal end 252 of wash cycle drive shaft 228. Hollow cylindrical connection end 272 includes a lateral openings 274 that aligned with second distal end lateral openings 258 of wash cycle drive shaft 228 for receiving fasteners 276 to fix wash and rinse cycle drive gear 250 with wash and rinse cycle drive shaft 228.

Manually operated washing machine 100 further provides a spin cycle drive system (for second mode of operations) comprised of spin cycle actuator assembly 132 that is associated with power transfer assembly 138, which when actuated by handle 114, ultimately generate a fast, one direction spinning motion of basket 104 to spin and extract water from laundry.

Spin actuator assembly 132 (FIGS. 6U to 6X) includes a second intermediate power transfer member 278 and a second busing 280, with second intermediate power transfer member 278 comprising a second power receiver portion 282 and a second power transfer portion 284.

Second power receiver portion 282 of second intermediate power transfer member 278 protrudes from a first side of a middle section 286 of second intermediate power transfer member 278, while second power transfer portion 284 protrudes from a second, opposite side of middle section 286 of second intermediate power transfer member 278.

Second power receiver portion 282 is comprised of a hollow cylinder with polygonal preferably, quadrilateral internal structure 288. The internal structural 288 configuration is commensurate with engaging end 156 of engagement member 154 to receive, mate (or engage) and enable transfer of power from handle 114 to power transfer drive shaft 290.

Second power receiver portion 282 has an outer circumference with a lateral opening that receives interlocking protuberance 176 of engaging end 156 of engagement member 144. Second power receiver portion 282 houses a third retention mechanism 292 (in a form of a disc magnet) that engages with first retention mechanism 182 at engaging end 156 of engagement member 154.

Second power transfer portion 284 of second intermediate power transfer member 278 is comprised of a hollow cylinder with polygonal preferably, quadrilateral internal structure 294. Internal structural 294 configuration is commensurate with sectional profile of power transfer drive shaft 290 to receive, mate (or engage) and enable transfer of power from handle 114 to power transfer drive shaft 290.

Manually operated washing machine 100 includes power transfer assembly 296 (FIG. 6T) comprising a power transfer drive shaft 290, and a power transfer gear assembly 298 associated with power transfer drive shaft 290. Power transfer drive shaft 290 has a longitudinally extending polygonal profile, commensurate with configuration of basket drive-hub 300 (detailed below).

A first distal end 302 of power transfer drive shaft 290 is connected with spin actuator assembly 132, while a second distal end 304 of power transfer drive shaft 290 is associated with basket 104 by the basket drive-hub 300. Power transfer gear assembly 298 is comprised of a beveled gear 306 with cogs 308 and a hollow cylindrical connection end (the gear hub) 310 that receives first distal end 302 of power transfer drive shaft 290. Hollow cylindrical connection end (the gear hub) 310 includes a lateral opening 312 that is aligned with lateral openings 314 of power transfer drive shaft 290 for securing them with fasteners 316.

As best illustrated in FIG. 6C, position of power transfer gear assembly (e.g., how far it should be positioned below first end 302) is dictated by the clearance required for operation of wash and rinse cycle drive gear 250 in relation to the spin actuator assembly 132 and proper meshing of both gears 250 and 306. Further, both wash and rinse cycle drive gear 250 and power transfer gear 306 are comprised of beveled gears with the their respective shafts 228 and 290 positioned at right angles from each other. Gears have matching pitch surfaces and angles, with a conically shaped pitch surface for transmitting rotational motion at a 90 degree angle. Beveled gears are cone-shaped gears that transmit power between intersecting axels.

As best illustrated in FIGS. 6C and 6D, when handle 114 is associated with wash and rinse cycle actuator assembly 124 (first mode of operation) and cranked in the direction shown by arrow 126, the wash and rinse cycle drive shaft 228 rotates bi-directionally (as shown by arrow 318) in accordance with the motion (back and forth cranking motion—approximately ¼ turn) of handle 114. Bidirectional rotation of wash and rinse cycle drive shaft 228 bi-directionally rotates power transfer drive shaft 290 along path indicated by arrow 320.

As further best illustrated in FIGS. 6C and 6D, when handle 114 is associated with spin cycle actuator assembly 132 (second mode of operation), axial actuation 134 of handle 114 spins spin cycle actuator assembly 132 in one direction only as shown by arrow 322, which, in turn, rotates power transfer shaft 290 in one direction as shown by arrow 324.

As further illustrated in FIGS. 1A to 6X and 7A, 7B, manually operated washing machine 100 further includes a cross-brace 326 that has a center opening relief 328 for passage of power transfer shaft 290, and a lateral set of openings 330 that secure distal ends of cross-brace 326 between lid 106 and tub 102. Center opening 328 is sufficiently sized to allow passage of power transfer shaft 290, and hub 310 of power transfer gear 306, while allowing the underside of power transfer gear 306 to rest on cross-brace 326.

In general, cross-brace 326 maintains power transfer shaft 290 from wobbling. That is, the cross-brace 326 keeps power transfer shaft 290 from moving out of axis. It should be noted that the primary supports for maintaining the power transfer shaft axial (preventing wobbling) are the distal end connection with the spin actuator assembly 132 and basket drive hub 300. Cross-brace 326 further aids in stability of the entire power transfer assembly 138, especially at power transfer gear 306 where power transfer shaft 290 may experience the largest forces (from wash and rinse cycle drive shaft 228 and spin actuator assembly 132).

As further illustrated in FIGS. 1A to 7J, manually operated washing machine 100 further includes tub 102 that has a housing 332 at a center thereof for supporting a second section 338 of a spindle 334 (best shown in FIGS. 7I and 7J), including a drain opening 122. As best shown in FIGS. 7C, 7D, 7E, and 7F, spindle 334 includes a first section 336 that enables a basket 104 to ride and spin on top end 340 of spindle 334 to allow for a low friction spinning point.

Second section 338 of spindle 334 friction fits into housing 332 of tub 102 and includes friction flanges (or ribs) 342 that comprise a cruciform configuration with upper distal ends having a slightly wider cross-section than a diameter of housing 332 of tub 102, enabling a press fit of spindle second section 338 into housing 332. This way, basket 104 rides on top end 340 of spindle 334 while spindle 334 is secured within spindle hub (or housing 332) of tub 102. Basket 104 riding on spindle 334 provides for a low friction spinning point, while the bottom (or second section 338) of spindle 334 friction-fit into housing or hub or socket 332 of tub 102 prevents spindle 334 itself from spinning.

As illustrated in FIGS. 1A to 7J, manually operated washing machine 100 further includes basket 104 (best shown in FIGS. 7E to 7H), situated or positioned within tub 102, on top 340 of first section 336 of spindle 334. As best shown in FIG. 7H, an interior of basket 104 is comprised of a drive hub 300 that includes a center drive-cavity 344 that receives a second distal end 304 of power transfer drive shaft 290. Drive hub 300 is further comprised of a set of interlocking drive flanges 346 that enabling coupling of a drive-shim link 348 with drive hub 300. As detailed below, drive-shim link 348 is press-fit onto drive hub 300.

Interior of basket 104 is further comprised of a set of flanges 350 projecting from the interior surface of basket 104 that function as agitators and further, serve to strengthen the structural integrity of basket 104 by functioning as stiffeners. A bottom exterior 352 of basket 104 is comprised of an exterior side 354 of drive hub 300, which defines a support hub 356 that rests and spins on a first side 336 of spindle 334, while a second side 338 of spindle 334 is secured within spindle housing or hub 332 of tub 102.

Figure 8A:
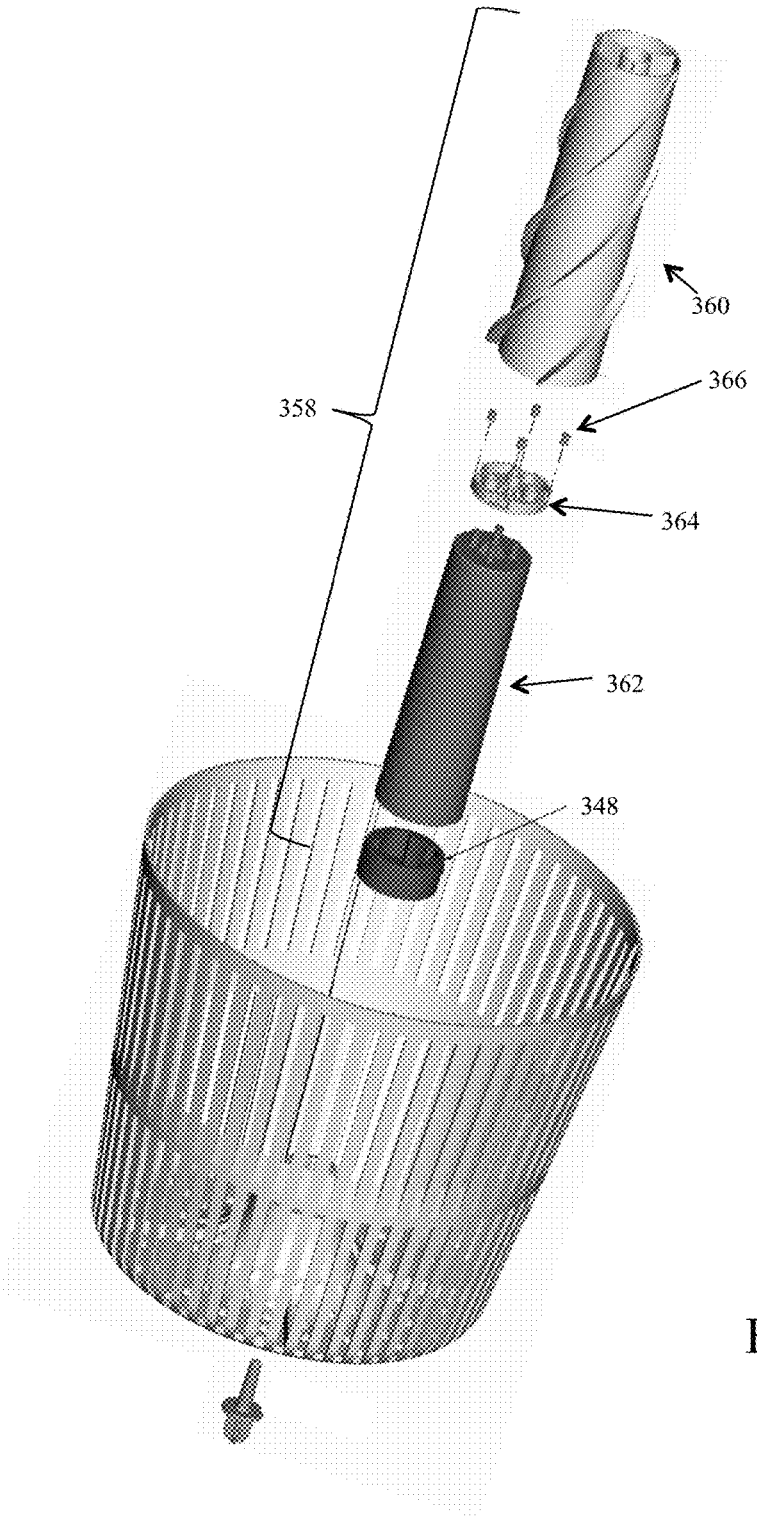
FIGS. 8A to 8U are non-limiting, exemplary illustrations that are generally directed to agitator assembly of the manually operated washing machine shown in FIGS. 1A to 7J in accordance with one or more embodiments of the present invention.
Figure 8B:
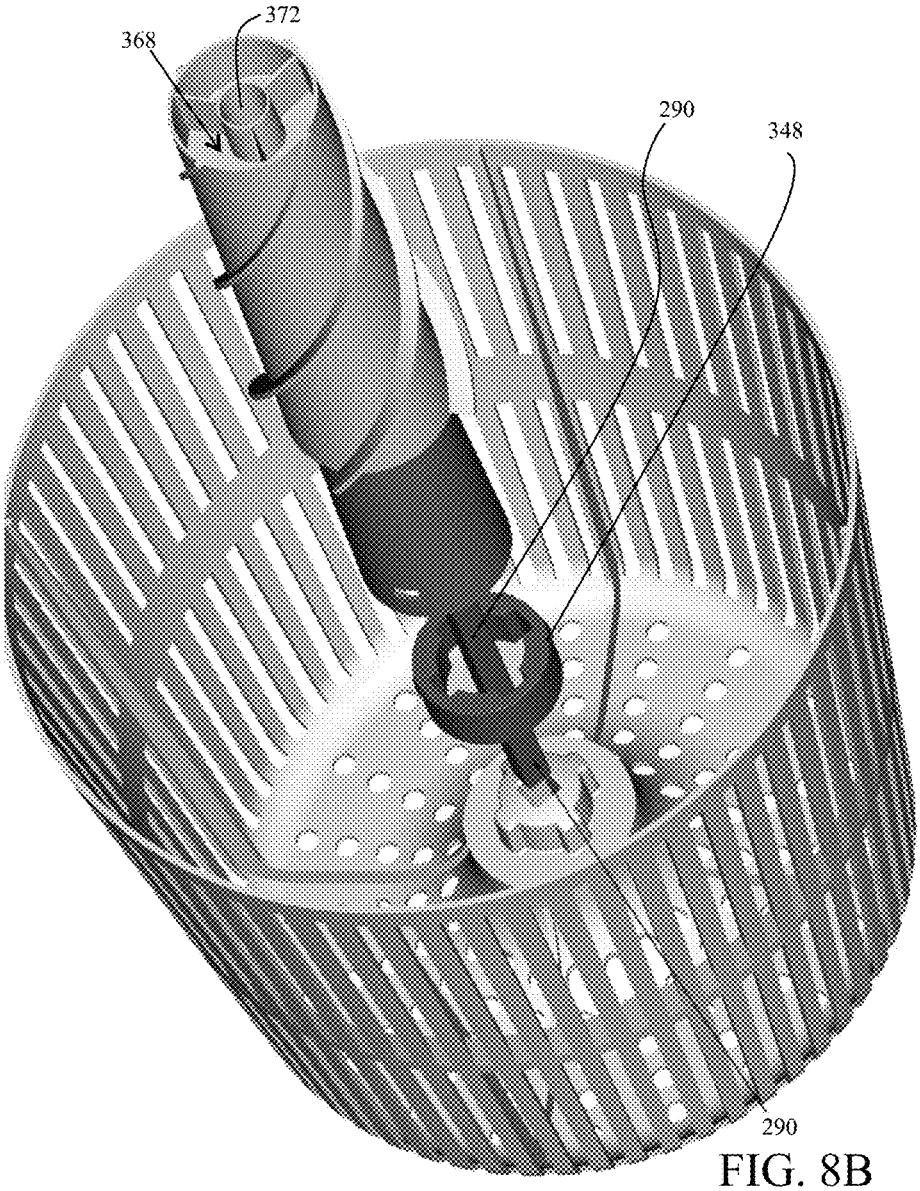
Figure 8C:
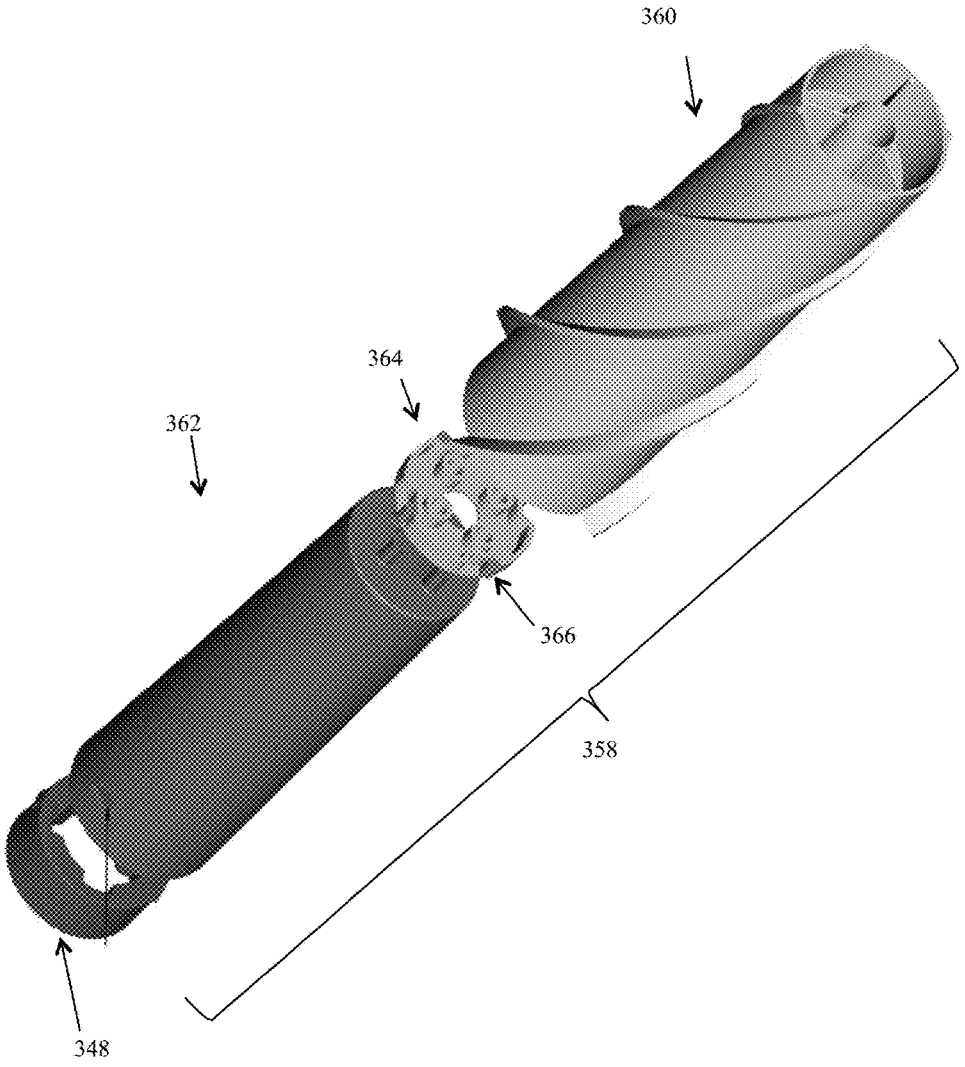
Figure 8D:
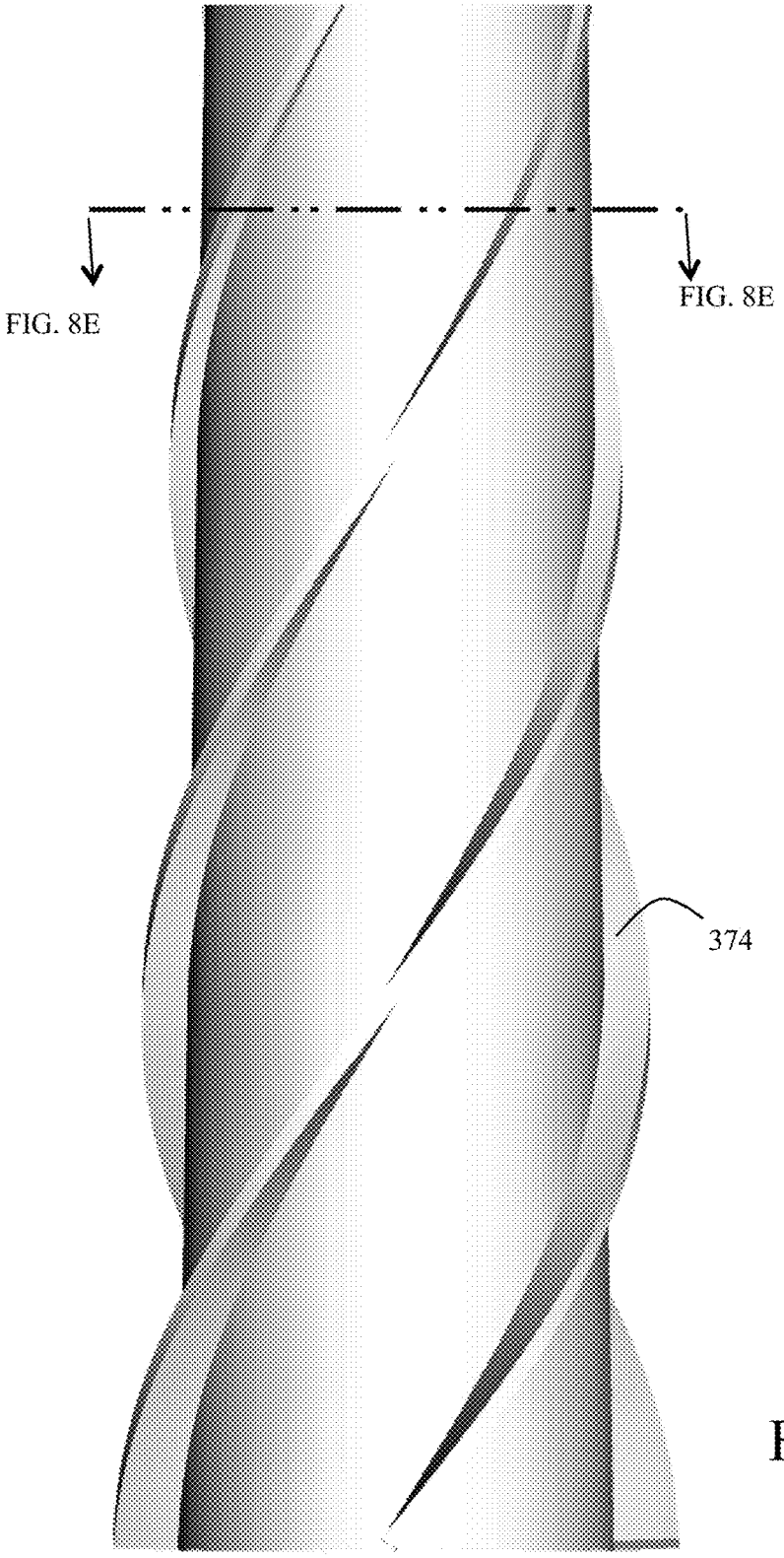
Figure 8E:
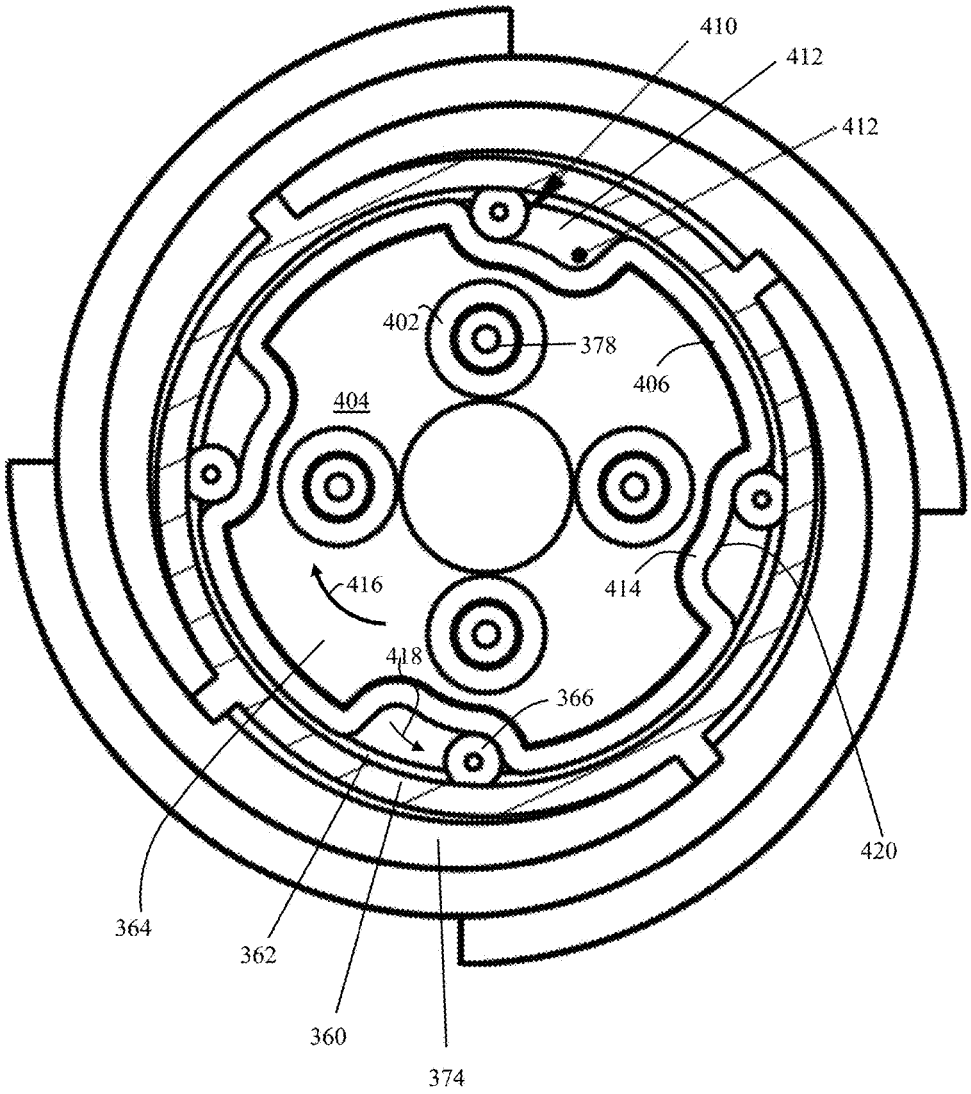
Figure 8F:
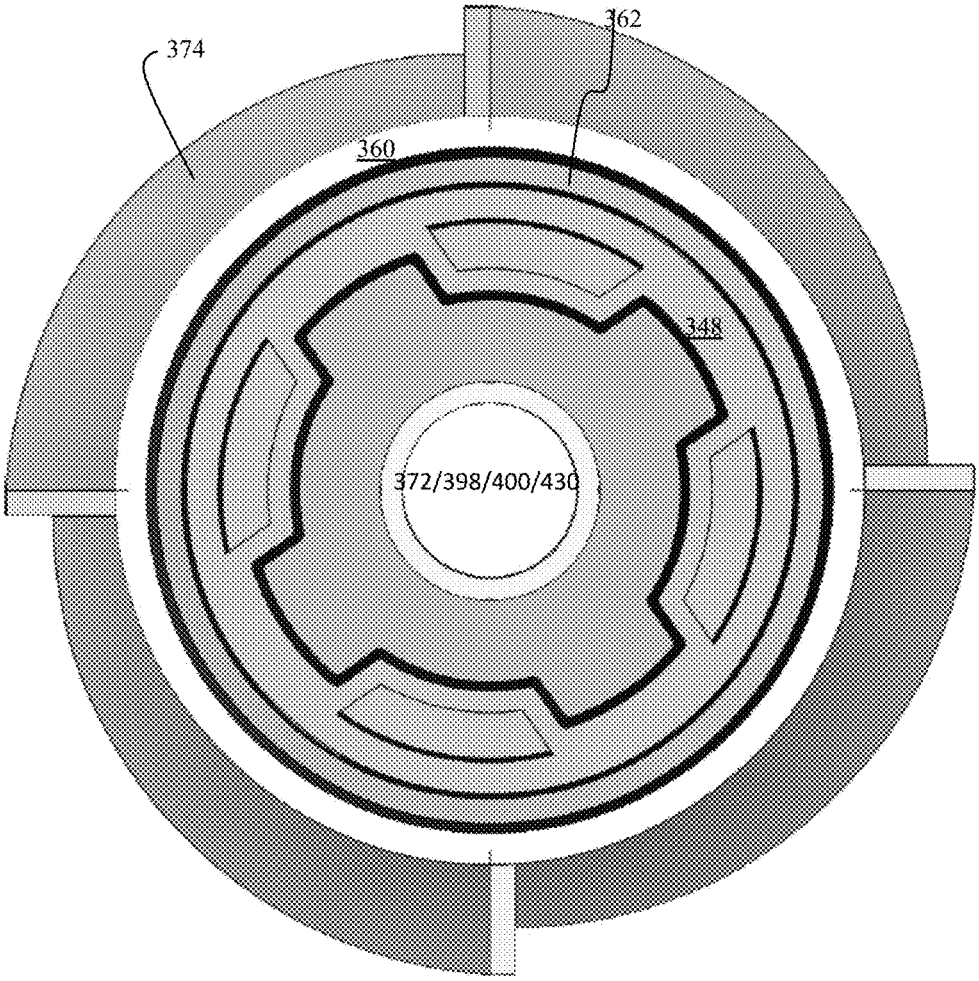
Figure 8G:
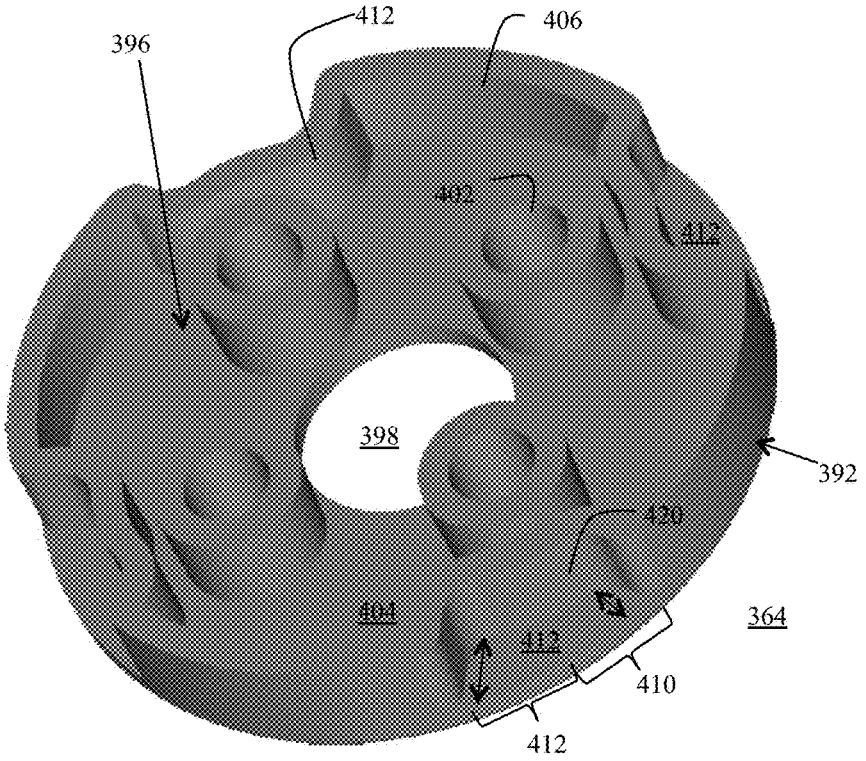
Figure 8H:
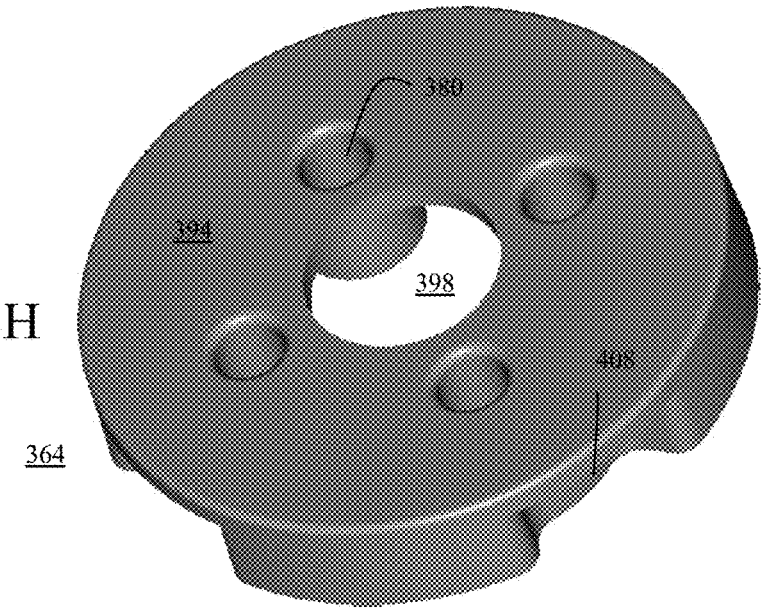
Figure 8I:
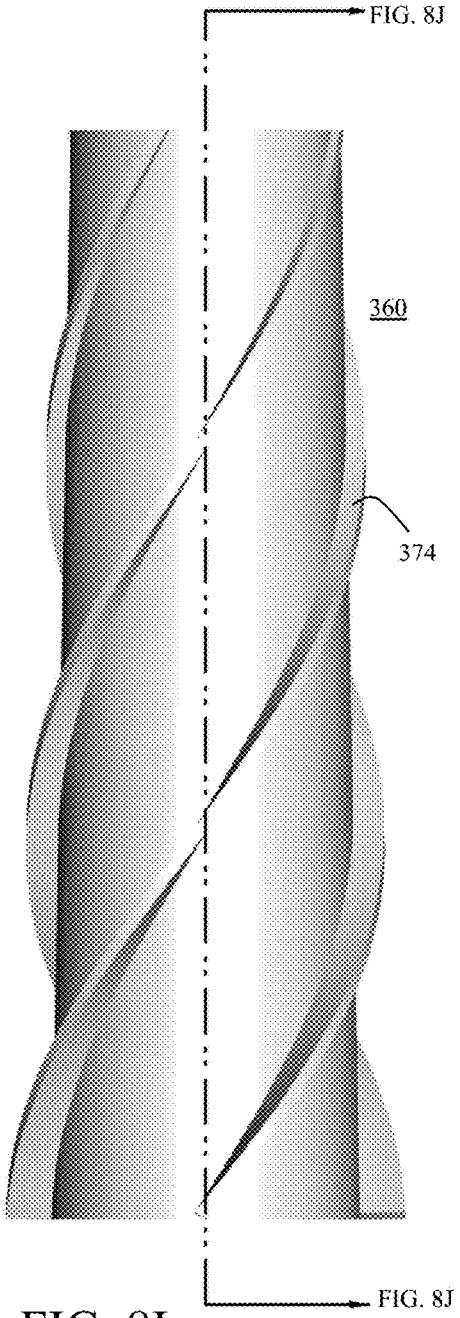
Figure 8J:
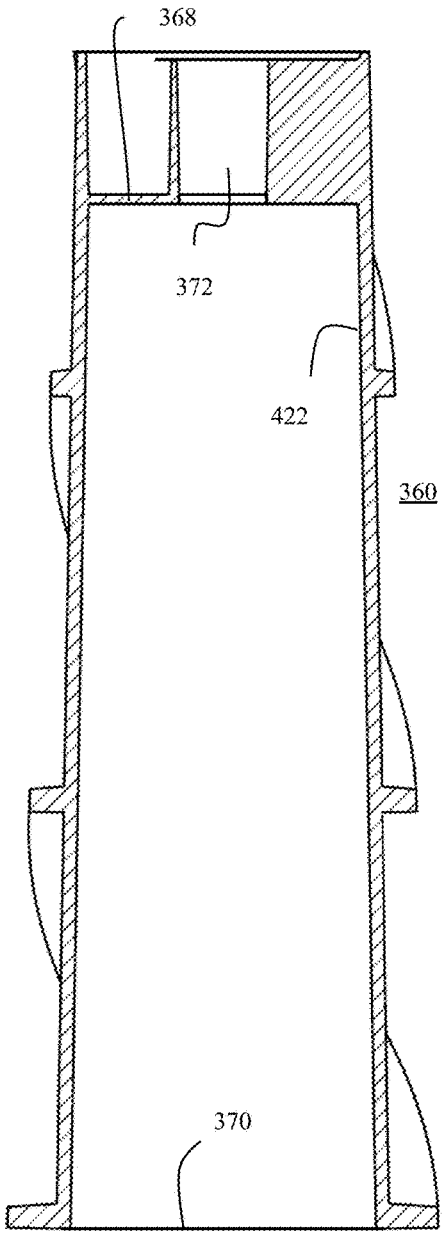
Figure 8K:
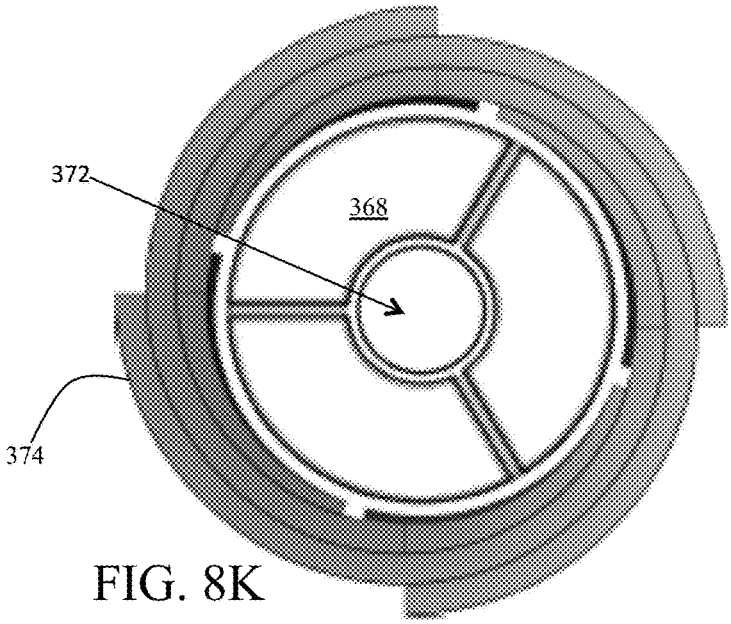
Figure 8L:
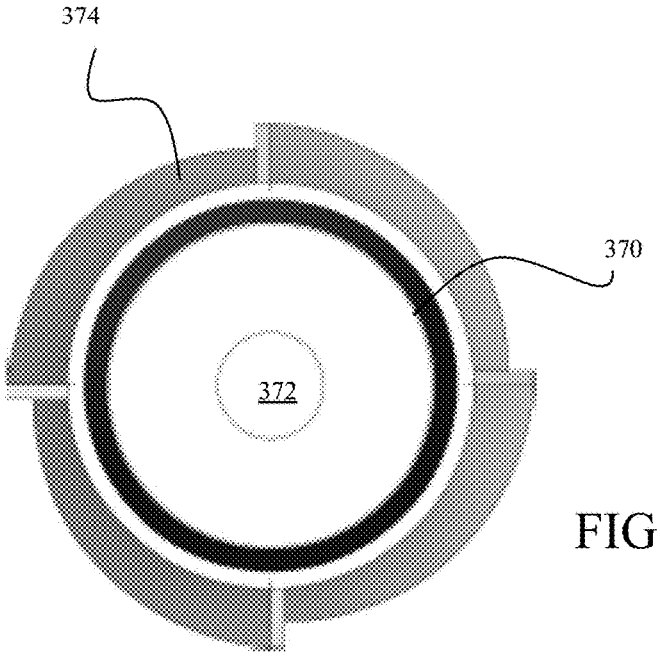
Figure 8M:
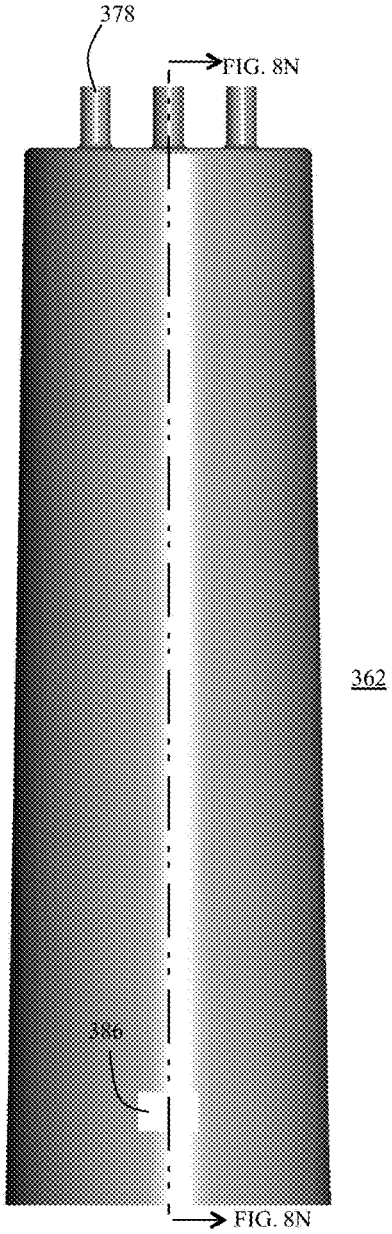
Figure 8N:
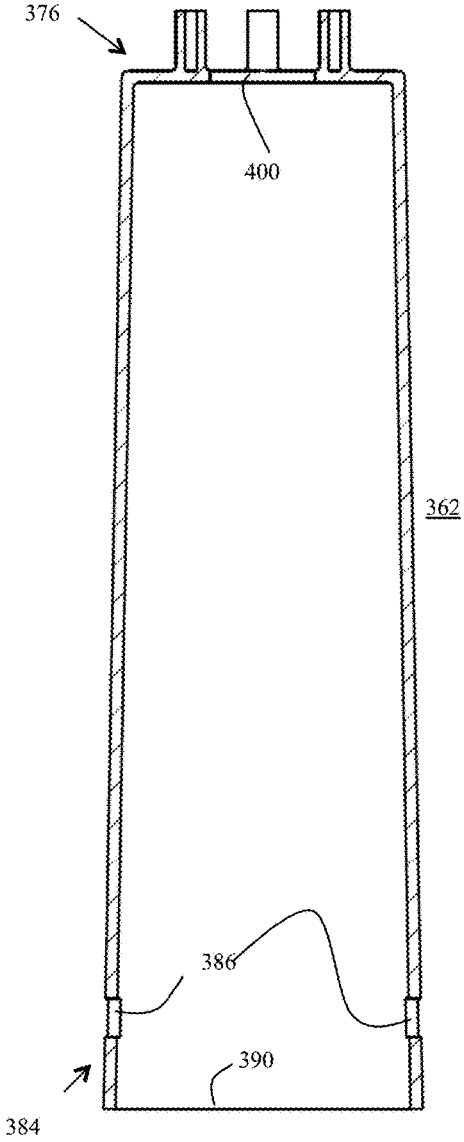
Figure 8O:
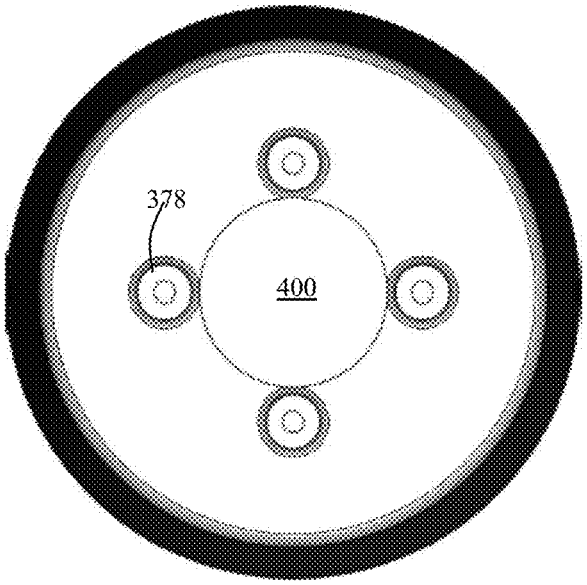
Figure 8P:
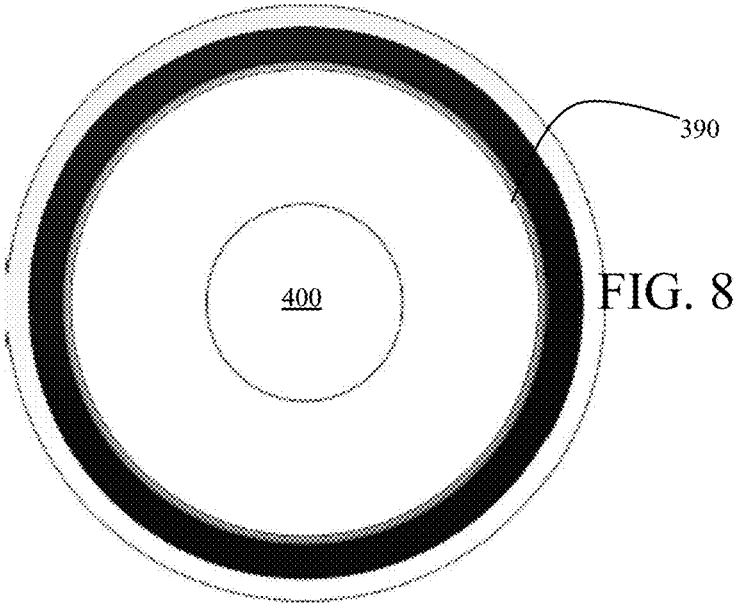
Figure 8Q:
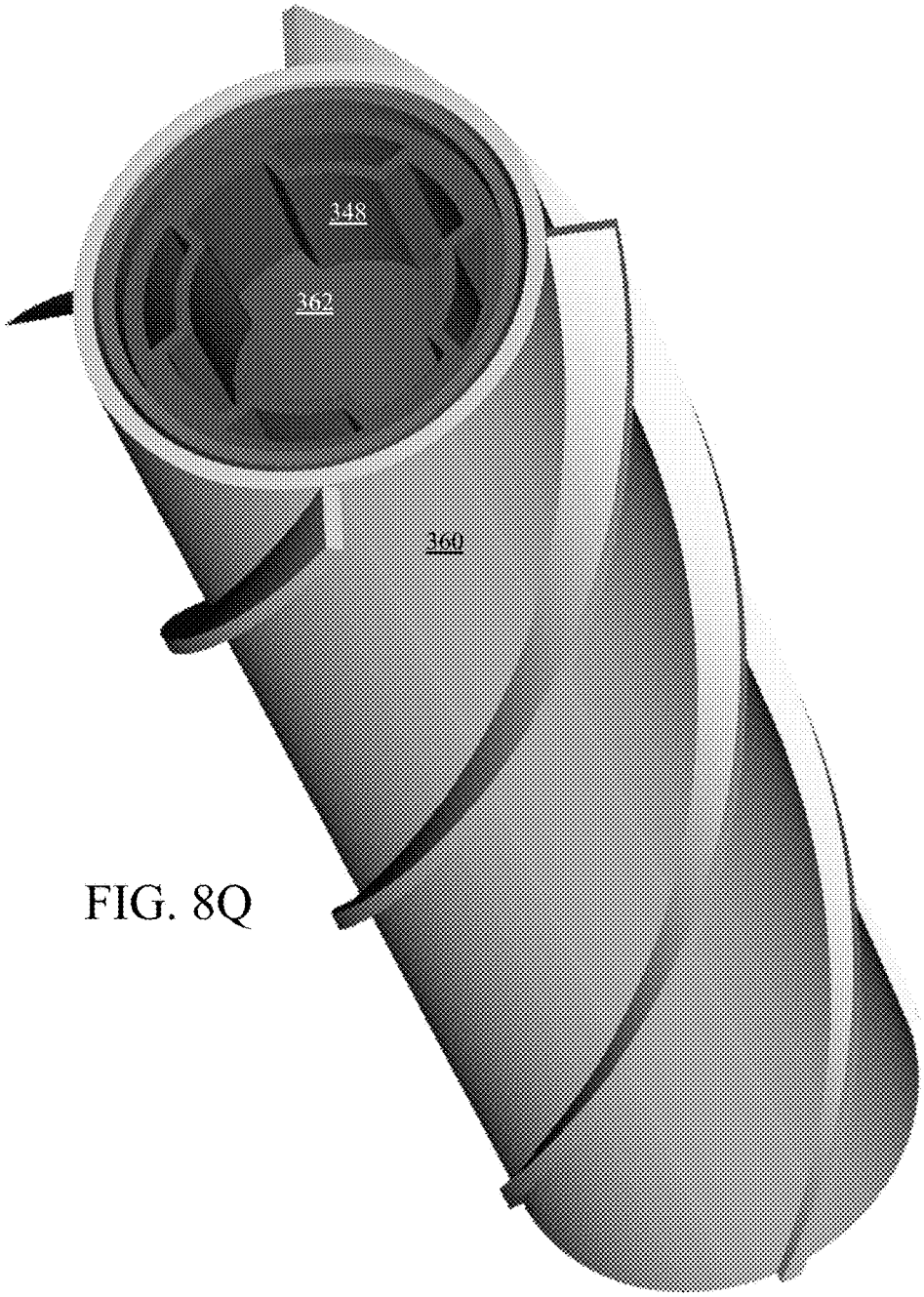
Figure 8R:
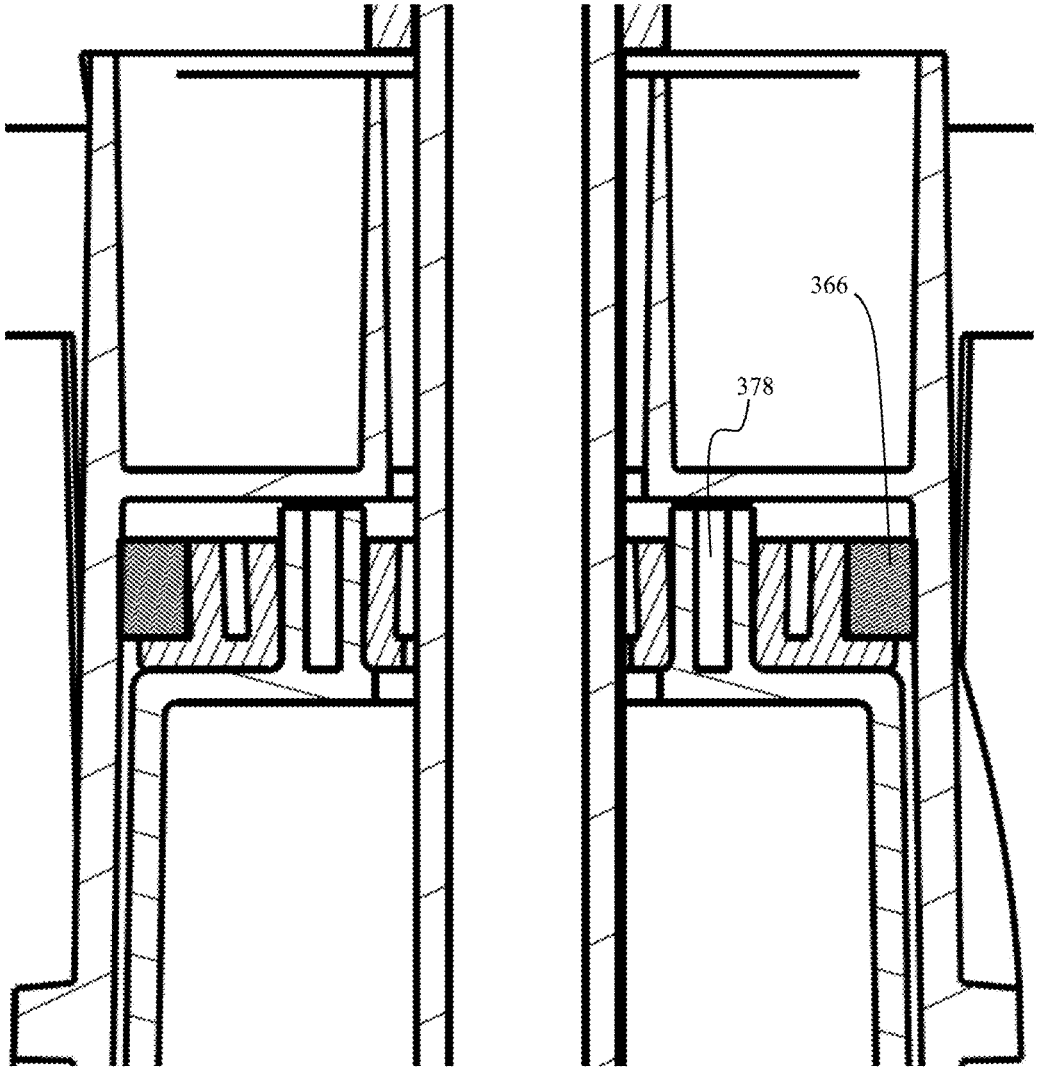
Figure 8S:
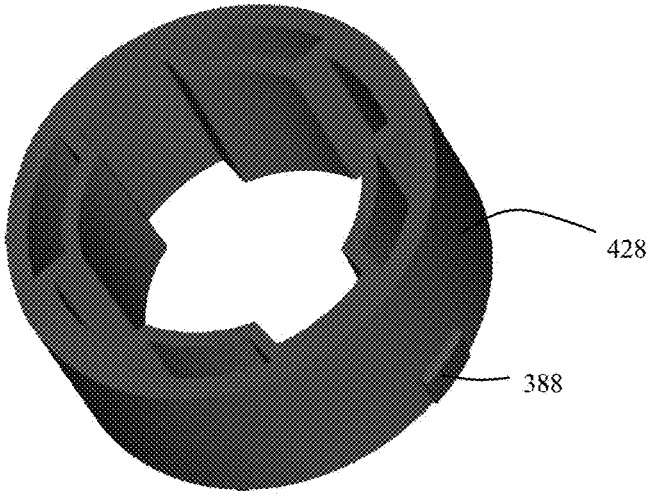
Figure 8U:
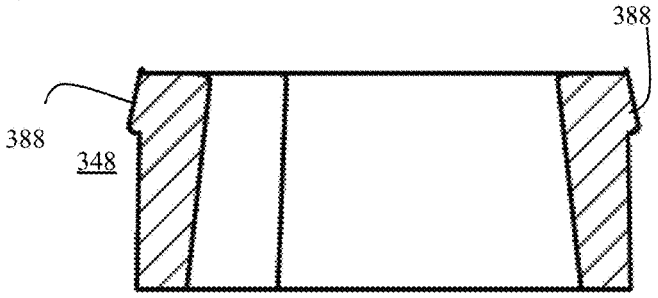
Figure 8T:
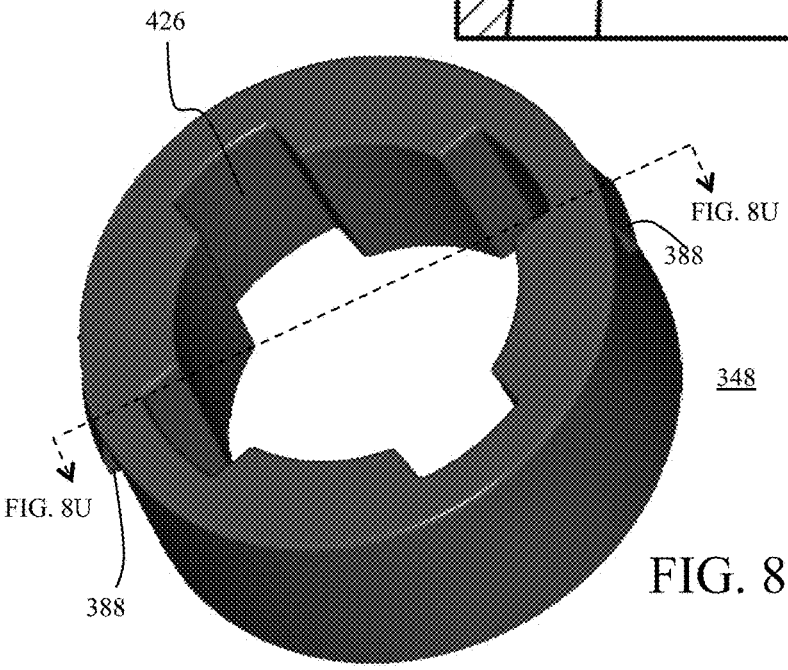

FIGS. 8A to 8U are non-limiting, exemplary illustrations that are generally directed to agitator assembly of manually operated washing machine shown in FIGS. 1A to 7J in accordance with one or more embodiments of the present invention. As illustrated, agitator assembly 358 is comprised of a first (or outer) agitator member 360, a second (or inner) agitator member 362, clutch 364 with a set of clutch dogs 366, and drive-shim link 348.

Top end 368 of first agitator member 360 is enclosed (with a central relief opening 372) to thereby prevent clutch 364 and clutch dogs 366 from falling out of agitator assembly 358. A bottom 370 of first agitator 360 is open for receiving second agitator member 362. Top end 368 of first agitator member 360 also includes relief-opening 372 with sufficient diameter to allow passage of power transfer shaft 290 without power transfer shaft 290 contacting first or second agitator members 360 and 362. First agitator further includes helical protrusions 374 that facilitate in further agitation of laundry (detailed below).

Second (or inner) agitator member 362 include a first distal end 376 that has connection posts 378 that mechanically connect with connection clutch openings 380 of the clutch 364. Connection posts 378 may be mechanically connected to connection clutch opening 380 by thermoplastic staking (or heat staking).

A second distal end 384 of second agitator member 362 includes lateral openings 386 that receive protruded engagement flanges 388 of the drive-shim link 348. That is, a bottom 390 of second agitator 362 is open for receiving drive-shim link 348, and including lateral openings 386 that interlock a set of lateral flanges 388 of drive-shim link 348. Second agitator member 362 is hollow and includes a central relief opening 400 with sufficiently wide diameter to all passage of power transfer shaft 290 without power transfer shaft 290 contacting second agitator member 360.

As indicated, agitator assembly 358 further includes a clutch 364 (best shown in FIGS. 8G and 8H) that has a clutch body 392 with a flat bottom side 394 (FIG. 8H) and a top side 396 (FIG. 8G). Clutch body 392 has a center relief (or opening) 398 for passage of power transfer shaft 290 without power transfer shaft 290 contacting clutch 364.

Clutch body 392 further includes the set of connection clutch openings 380 surrounding center relief 398, with the set of connection clutch openings 380 configured as a set of mounting bosses 402 protruding from a surface 404 of top side 396 that receive connection posts 378 of second agitator member 362.

Surface 404 of top side 396 of clutch body 392 is surrounded by partially concentric wall 406 and partially non-concentric walls 414, creating non-concentric indentation areas 408 (toward opening 398). Non-concentric indentations 408 have a first area or space 410 that is smaller than an adjacent larger area 412. As shown in FIG. 8E, when clutch 364 is rotated in a first direction 416 (when handle 114 is moved in the first direction, which moves second agitator member 360 in first direction 416), a set of clutch dogs 366 (cylindrical rollers) rotate and move (in opposite direction 418) towards the smaller area 410 of non-concentric indentations 408 and lock between outer surfaces 420 of non-concentric indentation walls 414 and inner surface 422 of first agitator member 360, which cause first agitator member 360 to spin in only one direction as shown by arrow 416.

When clutch 364 is rotated in second direction 418 (when handle is moved in the second direction, which moves second agitator member 362 in second direction 418), the set of clutch dogs 366 rotate and move (in opposite direction 416) towards larger area 412 of non-concentric indentations 408 between outer surfaces 420 of non-concentric indentation walls 414 and inner walls 422 of first agitator member 360, which cause first agitator member 360 to be free. In other words, clutch dogs 366 no longer frictionally lock first agitator member 360 with second agitator member 362. It should be noted that although there is surface to surface contact between first and second agitator members 360 and 362, they do not mechanically connect or lock or latch together. In other words, first agitator member 360 "floats" or "slides" over second agitator member 362. Further, although free to move, first agitator member 360 is actually impeded from moving due to the laundry load (water and clothes). This way, agitation is still achieved in only one direction.

Agitator assembly 358 further includes drive-shim link 348 (which as the name implies, is the actual link between basket 104 that receives direct drive power from shaft 290 and second agitator member 362). That is, drive-shim link 348 indirectly (via basket 104) transfers bi-directional rotational power from power transfer shaft 290 to agitator assembly 358, and in particular, second or open distal end 390 of second agitator member 362.

Drive-shim link 348 is comprised of an annular frustum disc with inner walls having recesses 426 that receive protruding flanges 346 of hub-drive 300 of basket 104, and outer wall 428 that include flexible flanges 388 that snap into lateral openings 386 of second agitator member 362. Drive-shim link 348 also includes a central opening relief 430 for passage of power transfer shaft 290 without power transfer shaft 290 contacting drive-shim link 348. Accordingly, agitator assembly 358 includes relief openings 372, 398, 400, and 430 to enable passage of power transfer shaft 290.

Referring back to FIG. 7H, as indicated above, during the first mode of operations of wash and rinse cycle, manually operated washing machine enables laundry to be agitated so to prevent laundry from being fixed to a stationary position within the basket during wash cycle. Agitation of the laundry includes moving laundry back and forth (first agitation force 432) while continuing to revolve 434 (e.g., clockwise) around a first axis Z-axis (parallel power transfer shaft 290) and revolve (e.g., counterclockwise downward near center of basket 104 and upward near walls 436 of basket 104)

around a second axis X- or Y-axis (perpendicular power transfer shaft 290) that is generally perpendicular the first axis (Z-axis).

As indicated above, handle 114 is rotated back-and forth between first and second angles within a plane that is perpendicular longitudinal axis of wash and rinse actuator assembly. The manual back and forth rotational motion of handle ultimately generates an agitating force that moves laundry within the basket, with the laundry moving back and forth while continuing to revolve around a first axis (around power transfer shaft 290) and a second axis (X- or Y-axis) that is generally perpendicular the first axis. Manually exerted force from the back and forth motion of handle drives wash and rinse cycle drive assembly to actuate a power transfer assembly so to rotate the basket. The basket rotates clockwise and counterclockwise between third and fourth angles, as the handle is rotated back-and forth between the first and the second angles. The manually exerted force from the back and forth motion of the handle rotates the basket clockwise and counterclockwise between third and fourth angle.

The clockwise and counterclockwise rotations of the basket generate a first agitating force that moves laundry floating within water in clockwise and counterclockwise directions. Simultaneously, a one-way rotation of the first agitator member of the agitator assembly generates a second agitating force the moves laundry through a full revolution around first axis while the laundry is moved in clockwise and counterclockwise directions due to continued application of the first agitating force. Further, the first agitator member further generates a third agitating force that rotates laundry around second axis, perpendicular the first axis while laundry is moved in clockwise and counterclockwise directions and is moved through the full revolution around the first axis. The first axis is oriented parallel a longitudinal axis of the basket (which is the same as the power transfer shaft 290) while second axis is parallel a transverse axis of the basket.

First agitator member is forced to rotate in one direction by the manually exerted force from handle and being friction locked with the clutch, which generates full revolution motion 434 around first axis (Z−) and full revolution motion 438 around second axis (X− or Y−). First agitator member is freed from the clutch and simply floats when the handle exerts a force in the opposite direction.

First agitator member is positioned and slides over an exterior surface of second agitator member that is mechanically linked by drive-agitator link with power transfer assembly. That is, the first agitator member freely rides on or rotationally slides or "floats" over and moves in relation to second agitator member, but is prevented from rotation in an opposite direction by the clutch assembly.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, instead of using a drive-shim link, the second agitator member may also be directly connected with the drive-hub (for example, a set of flanges may be provided on the distal end of the second agitator that snap into a set of recess (to be provided) within the drive-hub at surface location where the second distal end (the open end) of the second agitator member rests. However, the drive-shim link is preferred for simplicity in terms of manufacturing. That is, the drive-shim link is used because it would be difficult (manufacturing wise) to provide internal molding structures that would enable the second agitating member to directly connect with the basket drive-hub. Such variations and alternate embodiments are contemplated, and can be made without departing from the spirit and scope of the invention.

It should further be noted that throughout the entire disclosure, the labels such as left, right, front, back, top, inside, outside, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction, orientation, or position. Instead, they are used to reflect relative locations/positions and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

Further the terms "a" and "an" throughout the disclosure (and in particular, claims) do not denote a limitation of quantity, but rather denote the presence of at least one of the referenced item.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A manually operated washing machine, comprising:

a tub;

a basket movably associated with the tub;

an independent, detachable handle with an independent internal drive mechanism;

a single elongated power transfer drive shaft with polygonal profile that includes a first end mechanically fixed to a commensurately configured power transfer portion of a rotatable intermediate power transfer member;

the power transfer drive shaft includes a second end directly mechanically fixed to a drive hub of the basket;

the handle detachably couples with the power transfer drive shaft via a power receiver portion of the rotatable intermediate power transfer member;

in a first mode of operations for wash and rinse cycles for washing and rinsing laundry the power transfer drive shaft is driven by:

an in-plane motion of the handle rotated back-and forth between a first and second angles to actuate the basket in the first mode of operation;

wherein: the basket in the first mode of operation is rotated bidirectionally in a back-and-forth motion while the power transfer drive shaft is pivoted bidirectionally in back-and-forth by the motion of the handle; and in a second mode of operations for spin cycle for spinning for generally extracting excess water from laundry the power transfer drive shaft is driven by:

an axial motion of the handle along a longitudinal axis of the handle, which actuates the handle internal drive mechanism to actuate the basket in a second mode of operation;

wherein: the basket in the second mode of operation is unidirectionally rotated by the actuations of the handle drive mechanism.

2. The manually operated washing machine as set forth in claim wherein:

the laundry is agitated bidirectionally by the back and forth motion of the basket so to prevent laundry from being fixed to a stationary position during the first mode of operations.

3. The manually operated washing machine as set forth in claim 2, wherein:

the agitation of the laundry includes:

moving laundry back and forth while continuing to revolve around a first axis and to revolve around a second axis that is generally perpendicular the first axis.

4. The manually operated washing machine as set forth in claim 1, further comprising:

a lid associated with a top of the tub;

the lid includes a door that when at an open position enables access to an interior of the tub for placement and removal of laundry.

5. The manually operated washing machine as set forth in claim 4, wherein:

the handle includes a detachable engagement adapter that detachably engages a power receiver portion of the intermediate power transfer member.

6. The manually operated washing machine as set forth in claim 1, wherein:

the handle has an adjustable length that varies along a longitudinal axis of the handle.

7. The manually operated washing machine as set forth in claim 6, wherein:

the adjustable length of the handle is contracted in length and locked during wash and rinse cycles; and the adjustable length of the handle is extended in length and unlocked and free to move axially along the longitudinal axis of the handle during spin cycle to generate a spin power.

8. The manually operated washing machine as set forth in claim 1, wherein:

a manual back and forth rotational motion of the handle ultimately generates an agitating force that moves laundry within the basket back and forth while the laundry continues toy revolve around a first axis and to revolve around a second axis that is generally perpendicular the first axis.

9. The manually operated washing machine as set forth in claim 8, wherein:

the basket rotates bidirectionally clockwise and counterclockwise between third and fourth angles, as the handle is rotated back-and forth between first and second angles.

10. The manually operated washing machine as set forth in claim 9, wherein:

the clockwise and counterclockwise bidirectional rotations of the basket generate a first agitating force that moves laundry floating within water in a clockwise and counterclockwise directions; and a one-way rotation of a first agitator member of an agitator assembly generates a second agitating force that moves laundry through a full revolution around a first axis while the laundry is moved in clockwise and counterclockwise directions due to continued application of the first agitating force;

the first agitator member further generates a third agitating force that rotates laundry at a second axis, perpendicular the first axis while laundry is moved in clockwise and counterclockwise directions while laundry is moved through the full revolution around the first axis.

11. The manually operated washing machine as set forth in claim 10, wherein:

the first agitator member is caused to rotate in one direction by a clutch assembly.

12. The manually operated washing machine as set forth in claim 10, wherein:

the first agitator member is positioned and slides over an exterior surface of a second agitator member that is mechanically linked with power transfer drive shaft.

13. A manually operated washing machine, comprising:

a tub;

a basket movably associated with the tub;

an independent, detachable handle with an independent internal drive mechanism;

a single elongated power transfer drive shaft that includes a first end mechanically fixed to a power transfer portion a rotatable intermediate power transfer member;

the power transfer drive shaft includes a second end directly mechanically fixed to a drive hub of the basket;

the handle detachably couples with the power transfer drive shaft via a power receiver portion of the rotatable intermediate power transfer member;

wherein: during a wash and rinse cycle laundry is agitated in part by an agitator assembly, comprising:

an outer agitator member positioned over an inner agitator member;

a clutch mechanically connected to a first distal end of the inner agitator member and operatively engaging and disengaging the outer agitator member;

a drive-shim link mechanically connected to a second distal end of the inner agitator member and the drive hub of the basket;

wherein: bidirectional rotations of the basket by the power transfer drive shaft generate a first agitating force that bidirectionally moves laundry floating within water;

rotation of the basket in a first direction of the bidirectional rotation causes a one-way rotation of the outer agitator member due to the operative engagement of the clutch with the outer agitator member;

the one-way rotation of the outer agitator member generates an additional second agitating force that moves laundry through a full revolution around a first axis, while further generating an additional third agitating force, which rotates laundry at a second axis, perpendicular the first axis;

rotation of the basket in a second direction, opposite the first direction disengages the clutch from the outer agitator member allowing the outer agitator member to free-float while laundry is moved bidirectionally due to continued application of the first agitating force;

wherein: the laundry is moved bidirectionally while moving through a full revolution around the first axis and the second axis due to first, second, and third agitating forces; and a spin cycle that generally extracts excess water from laundry;

wherein: the basket is unidirectionally rotated by the actuations of the handle drive mechanism of the handle coupled with the power transfer drive shaft.

14. The manually operated washing machine as set forth in claim 13, wherein:

the clutch includes a set of clutch, dogs that operatively engage and disengage the outer agitator member to enable the outer agitator member to respectively have the one-way rotational motion and be free-floating.

15. A manually operated washing machine, comprising:

a tub;

a basket movably associated with the tub;

an agitator assembly associated with the basket;

an independent, detachable handle with an independent internal drive mechanism;

a single elongated power transfer drive shaft with polygonal profile that includes a first end mechanically fixed to a commensurately configured power transfer portion of a rotatable intermediate power transfer member;

the power transfer drive shaft includes a second end directly mechanically fixed to a drive hub of the basket;

the handle detachably couples with the power transfer drive shaft via a power receiver portion of the rotatable intermediate power transfer member;

in a first mode of operations for wash and rinse cycles for washing and rinsing, laundry the power transfer drive shaft is driven by:

an in-plane motion of the handle rotated, back-and forth between a first and second angles to actuate the basket in the first mode of operation;

wherein: the basket in the first mode of operation is rotated bidirectionally in a back-and-forth motion while the power transfer drive shaft is pivoted bidirectionally in back-and-forth by the motion of the handle; and in a second mode of operations for spin cycle for spinning for generally extracting excess water from laundry the power transfer drive shaft is driven by:

an axial motion of the handle along a longitudinal axis of the handle, which actuates the handle internal drive mechanism to actuate the basket in a second mode of operation;

wherein: the basket in the second mode of operation is unidirectionally rotated by the actuations of the handle drive mechanism;

the laundry is further agitated by the agitator assembly, comprising:

an outer agitator member positioned over an inner agitator member;

a clutch mechanically connected to a first distal end of the inner agitator member, with the clutch including a set of clutch-dogs that operatively engage and disengage the outer agitator member;

a drive-shim link mechanically connected to a second distal end of the inner agitator member and a drive hub of the basket:

wherein: bidirectional rotations of the basket by the power transfer drive shaft generate a first agitating force that bidirectionally moves laundry floating, within water;

the rotation of the basket in a first direction of the bidirectional rotation causes a one-way rotation of the outer agitator member due to the operative engagement of the clutch-dogs with the outer engagement member;

the one-way rotation of the outer agitator member generates an additional second agitating force that moves laundry through a full revolution around a first axis, while further generating an additional third agitating force, which rotates laundry at a second axis, which is perpendicular to the first axis;

rotation of the basket in a second direction, opposite the first direction disengages the clutch dogs from the outer agitator member allowing the outer agitator member to free-float while laundry is moved bidirectionally due to continued application of the first agitating force;

wherein: the laundry is moved bidirectionally while moving through a full revolution around the first axis and the second axis due to first, second, and third agitating forces.

* * * * *